US010550524B2

(12) United States Patent
Yu

(10) Patent No.: US 10,550,524 B2
(45) Date of Patent: Feb. 4, 2020

(54) BEVELED-END STEEL RAILROAD

(71) Applicant: Hui Yu, Guangdong (CN)

(72) Inventor: Hui Yu, Guangdong (CN)

( * ) Notice: Subject to any disclaimer, the term of this patent is extended or adjusted under 35 U.S.C. 154(b) by 0 days.

(21) Appl. No.: 16/004,351

(22) Filed: Jun. 9, 2018

(65) Prior Publication Data

US 2018/0291562 A1 Oct. 11, 2018

Related U.S. Application Data

(63) Continuation of application No. PCT/CN2016/000223, filed on Apr. 26, 2016.

(30) Foreign Application Priority Data

Dec. 9, 2015 (CN) ..... 2015 1 0922206

(51) Int. Cl.
*E01B 11/24* (2006.01)
*E01B 11/26* (2006.01)

(52) U.S. Cl.
CPC ..... *E01B 11/24* (2013.01); *E01B 11/26* (2013.01)

(58) Field of Classification Search
CPC ..... E01B 11/20; E01B 11/22; E01B 11/24; E01B 11/26; E01B 11/28
See application file for complete search history.

(56) References Cited

U.S. PATENT DOCUMENTS 795,733 A * 7/1905 Robins ..... E01B 11/24 238/232
1,234,001 A * 7/1917 Fitzgerald ..... E01B 11/24 238/232
1,292,520 A * 1/1919 Roy ..... E01B 11/24 238/232
2,633,302 A * 3/1953 Cooper ..... E01B 11/44 238/164
3,352,491 A * 11/1967 Nelson ..... E01B 11/10 238/209
3,499,604 A * 3/1970 Nelson ..... E01B 11/24 238/230

(Continued)

FOREIGN PATENT DOCUMENTS

AU 428115 B2 9/1972
CN 2032211 U 2/1989

(Continued)

*Primary Examiner* — Jason C Smith
(74) *Attorney, Agent, or Firm* — Wayne & Ken, LLC; Tony Hom

(57) ABSTRACT

A beveled-end steel railroad. The use of small-acute-angle oblique-gap connection design and vertical gap reservation design can solve both the problem of impact between wheels and rails and the problem of thermal stress between steel rails. The design containing both beveled ends and flat ends that are complementary to each other can further greatly reduce railroad construction and reformation costs. The beveled-end steel railroad has a simple structure, is secure, reliable, and durable, can provide a fast, stable, and non-noisy driving effect, can implement highly-efficient and energy-saving operation, is easy to construct and reform, can be easily repaired and maintained, has a significant advantage in costs, and can implement both good performance and good profitability.

5 Claims, 8 Drawing Sheets

(56) References Cited

U.S. PATENT DOCUMENTS

Figure 1:
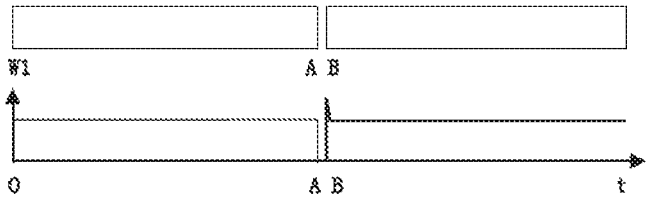

| | | | | |
|---|---|---|---|---|
| 2013/0186968 | A1* | 7/2013 | Song | E01B 11/44<br>238/164 |
| 2014/0034744 | A1* | 2/2014 | Hayden | E01B 11/24<br>238/169 |
| 2015/0361621 | A1* | 12/2015 | Maenpaa | E01B 11/24<br>238/151 |
| 2018/0291562 | A1* | 10/2018 | Yu | E01B 11/26 |

FOREIGN PATENT DOCUMENTS

| | | | |
|---|---|---|---|
| CN | 2112648 | U | 8/1992 |
| CN | 1172879 | A | 2/1998 |
| CN | 2292830 | Y | 9/1998 |
| CN | 2310785 | Y | 3/1999 |
| CN | 2350427 | Y | 11/1999 |
| CN | 2424227 | Y | 3/2001 |
| CN | 1305035 | A | 7/2001 |
| CN | 2659933 | Y | 12/2004 |
| CN | 2743406 | Y | 11/2005 |
| CN | 203065904 | U | 7/2013 |
| CN | 105386371 | A | 3/2016 |
| CN | 205100036 | U | 3/2016 |

* cited by examiner

BEVELED-END STEEL RAILROAD

FIELD OF THE INVENTION

The International Patent Classification (IPC) of the present invention is B61B and can be used for various railways and rail facilities.

BACKGROUND OF THE INVENTION

Since the first railway in the world is constructed by Britain in 1825, the problem of impact between wheels and steel rails and also rail gaps and the problem of thermal stress of steel rails have not been solved simultaneously and completely all the time.

For standard steel railways, transversal rail gaps have been reserved between steel rails to solve the problem of thermal stress of steel rails, which yet bring about the problem of impact between wheels and rails. Impact between wheels and rails not only significantly accelerates loss of wheels and rails, but also generates impact vibrations and noise. This not only significantly increases the cost of repair and replacement of trains and railways, but also reduces passenger comfort and cargo transportation safety.

For seamless steel railways, in order to solve the problem of impact between wheels and rails, standard steel rails are welded to form a seamless steel railway with a length of a few hundred meters to several kilometers, or a super long seamless steel railway is used. In this way, although impact between wheels and rails can be eliminated for the seamless steel rail, but transversal rail gaps still exist between the seamless steel rails. Therefore, by using seamless steel railway, the impact between wheels and rails can only be reduced rather than completely eliminated.

Seamless steel railways mainly use the design of thermal stress seamless line to limit thermal stress of the steel rails, that is, high-strength bolts, buckle fasteners or snap fasteners, etc. are used to lock the steel rails, so that free expansion and contraction of the seamless steel rails are limited via line resistance; alternatively, the type of thermal-stress-releasing seamless line design is used to reduce and control thermal stress of the steel rails. However, both methods can only limit and control thermal stress of the steel rail in a certain range, and if problem occur in some link of the thermal stress limitation and control (e.g., during locking of the steel rails), or if the ambient temperature changes beyond the design range (e.g., extreme weather occurs), accidents of breaking welds or expanding rails of the steel rails would occur. In case of seamless steel railways, welding and locking of steel rails are required, the qualities of rail welds, rail fasteners, sleepers, and roadbeds have greater impact on railway safety, and there are more uncertainties and higher probability of failure. Seamless steel rails are longer and thermal stress is greater, more attachments are needed for each steel rail, and there are more uncertainties and higher probability of failure. In areas having great temperature differences, thermal stress of the steel rails varies more, rail welds, rail fasteners, sleepers and roadbeds experience higher stress intensity, and there are more uncertainties and higher probability of failure. Seamless steel railways impose higher requirements on line stability, and geological, climate, and natural disasters have greater impact on railway safety. In addition, problems of unstable weld quality and high end breakage rates further exist in use of seamless steel railways. Therefore, seamless steel railway has not completely solved the problem of thermal stress on the steel rails, and there are still many safety risks.

Seamless steel railways require welding and locking of steel rails, which significantly add quality requirements and construction difficulties of rail welds, rail fasteners, sleepers and roadbeds, thereby multiplying construction and maintenance costs of railways. Seamless steel rails are longer, need on-site welding, requires large paving equipment and work in cooperation of more technical personnel, which increase costs of the equipment and labor for railway construction. Seamless steel rails are longer, which also increases production and transportation costs of steel rails. Further, repair and maintenance both are more difficult and demanding for seamless line, and this also significantly increase costs of repair and maintenance. Therefore, construction and maintenance costs of seamless steel railways are high.

In summary, standard steel railways solve the problem of thermal stress on the steel rails and yet bring the problem of impact between wheels and rails. Seamless steel railways cannot completely eliminate the impact between wheels and rails on one hand, and also multiply construction and maintenance costs of railways on the other hand. They cannot solve the problem of thermal stress of the steel rails completely, and there are many hidden safety hazards. Neither the standard steel railways rail nor the seamless steel railway can completely solve the problem of impact between wheels and rails and the problem of thermal stress of steel rails simultaneously.

SUMMARY OF THE INVENTION

Bevel-end steel railways use the design of small acute angle bevel rail gap coupling and the design of reserved longitudinal rail gap, which can completely solve the problem of impact between wheels and rails and the problem of thermal stress of steel rails simultaneously! The use of bevel-flat-end steel rail compatible and complementary design can also greatly reduce the cost of railway construction and renovation!

The bevel-end steel railways adopt the design of small acute angle bevel rail gap coupling, which can completely eliminate the impact between wheels and rails and significantly reduce loss of train and railway and maintenance costs thereof. This design can also significantly reduce resistance, vibration and noise of the train during travelling, and further increase speed and reduce energy consumption. Use of the design of small acute angle bevel rail gap coupling can also multiply thermal stress adjustment performance of the railway, enabling normal operation of the bevel-end steel railway in areas having high temperature differences.

The bevel-end steel railways also adopt the design of reserved longitudinal rail gap, which can completely solve thermal stress problem of the steel rails and can comprehensively improve safety of the steel railway. The bevel-end rail rails do not require welding, limiting and locking of the steel rails, and can be constructed under technical standards and quality requirements for ordinary railways, which not only improve overall reliability of the steel railway, but also significantly reduce cost of railway construction and maintenance.

The bevel-end steel railway also adopts bevel-flat-end rail compatible and complementary design. Therefore, existing equipments can be used to produce standard bevel-end steel rails, standard steel rails can be renovated into bevel-end steel rails to continue to be used, standard steel rails with worn and scrapped ends can be renovated into bevel-end steel rails to make waste utilization, and existing sleepers and line accessories can be fully employed. This avoid huge waste of previous investment caused by replacement of steel rails, sleepers, line accessories and production equipments, and can also avoid huge reinvestment. It adopts bevel-flat-end rail compatible and complementary design, and the standard bevel-end steel rails can be compatible with the standard steel rails renovated by bevel ends. Existing railways can be renovated directly according to the "interval replacement" and "partial interval replacement" methods, which can greatly reduce the cost of railway reconstruction.

Bevel-end steel railways completely solve the two major technical problems simultaneously that constrained railway development for 190 years, comprehensively improve technical performances of railways, and lay a technical foundation for upgrading of railways. The bevel-end steel railway design has a simple structure, is easy to construct and renovate, can be flexibly constructed and has obvious cost advantages, which create favorable conditions for large-scale construction and renovation of bevel-end steel railways. The bevel-end steel railway are safe, reliable and durable, provide fast and smooth travel for the train and also comfortable and quiet ride for the passengers, and are convenient for repair and maintenance, which provide technical guarantees for efficient use of railways and highly beneficial operation. Bevel-end steel railways have excellent performance and benefits, and are suitable for promotion and wide application!

(I) Technical Solutions

1. Elimination of the Impact Between Wheels and Rails

To solve the problem of impact between wheels and rails, we must understand the causes of the impact, and then try to eliminate the conditions for the impact to occur.

(1) Basic Conditions for the Impact Between Wheels and Steel Rails not to Occur

When the train is traveling on the steel railway, the wheels are continuously rolling on the steel rail's rail plane. When the train brakes, the wheels slide on the steel rail's rail plane. As long as the steel railway's rail plane remains continuous and smooth, and as long as the wheel tread plane plane of the train remains smooth, there would no impact between wheels and steel rails.

(2) Causes of Impact Between Wheels and Steel Rails in Case of Flat-End Steel Rail The steel rails used on various existing railways are flat-end steel rails. To facilitate comparison with the bevel-end steel railways and description, in the following, standard steel railways and seamless steel railways are collectively referred to as flat-end steel railways, and joints of standard steel railways and joints seamless steel railways are collectively referred to as flat-end rail joints.

① Causes of Impact Between Wheels and Rail Gaps of Flat-End Steel Rail

The round wheels of the train have a certain width and curvature. When the wheels roll (travel) or slide (brake) on the steel rails, only the very narrow lateral tread plane below the vertical axis of the wheel axle is in contact with the steel railway rail plane. On the flat-end steel railways, the rail gaps at the steel rail joints are all transversal notches. When the wheels roll to notches of the rail gaps of the steel rails, since the lateral tread planes of the wheels cannot be supported by the transversal rail gap notches, the wheels will fall forward and downward as a result of the resultant force of the compartment pressure (vertical) and the locomotive traction force (forward), and then collide with the initial edge of the steel rail in front of the notch of the rail gap. Since the train is heavy and the speed of travel is high, the interaction force between the wheel tread planes and the steel rail edges at both ends of the steel rail gaps is huge. When the wheel tread plane is pressing at one end edge of the notch and colliding with the other end of the notch, there will be two obvious vibrations and a loud "bang, bang" noise. The huge impact force will damage the wheel tread planes and the steel rail edges at the ends of notches of the rail gaps.

② Force Transfer Process at the Flat-End Steel Rail Joints

The force transfer process at the flat-end steel rail joints is shown in FIG. 1, and FIG. 1 comprises a top plan view of the rail plane at the flat-end steel rail joint and a rectangular coordinate system corresponding thereto in the vertical direction.

In the top plan view of the rail plane at the flat-end steel rail joint, the two oblong rectangles are the rail planes of two adjacent standard steel rails, where point A is the end point of the left standard steel rail at the flat-end steel rail joint and point B is the end point of the right standard steel rail at the flat-end steel rail joint, and between AB is the transversal rail gap at the flat-end steel rail joint.

In the rectangular coordinate system, the force transfer process of the two (left and right) standard steel rails at the flat-end steel rail joint is indicated, where the section 0-A is the force process of the left standard steel rail at the flat-end steel rail joint, and the section after B is the force process of the right standard steel rail at the flat-end steel rail joint, the vertical axis W1 in the rectangular coordinate system represents the magnitude of the steel rail force, and the transversal axis t represents the time.

It can be seen that during the process of the wheel passing through the flat-end steel rail joint, at point A, the force on the left standard steel rail momentarily decreases from the entire of the wheel pressure to zero, while at point B, the force on the right standard steel rail suddenly rises from zero to its maximum value. The end point B of the right standard steel rail suddenly receives a huge impact from the resultant force of the wheel pressure and the locomotive traction force. The resultant force is significantly larger than the wheel pressure, and the direction of the resultant force directs to the forward and downward direction with respect to the advancing direction of the train (the magnitude and direction of the resultant force can be accurately marked with vector drawings). After the wheel passes point B, the force on the right side of the standard steel rail turns back to normal, which is equivalent to the entire of the wheel pressure (the direction is vertically downwards). Between the points A and B at the flat-end steel rail joint, due to the gap between adjacent standard steel rails, rapid fluctuations in the steel rail support force (sudden disappearance and sudden recovery) are caused, and abrupt interruption during the force transfer process at the flat-end steel rail joint and the fluctuation of force magnitude are further induced, which will inevitably lead to the impact between the wheel and the flat-end steel rail joint and thus vibration.

(3) The Principle of Eliminating Impact Between Wheels and Rails in Case of Bevel-End Steel Railways The steel rail has a long strip structure, and the steel rail plane and both edge lines of the steel rail are parallel to the extension of the steel rail. To facilitate the design and reference of the bevel-end steel rail design, the centerline (parallel to and at equal distance from both edge lines of the steel rail plane) of the steel rail plane is set as the longitudinal axis of the steel rail.

① Bevel-End Rail Gaps Eliminate Impact Between Wheels and Rails

It is known that when a wheel of a train rolls (travels) or slides (brakes) on a rail, only the very narrow lateral tread plane below the wheel axis is in contact with the steel rail's plane. The problem of impact between wheels and rails for the flat-end steel rails are caused exactly by the fact that the lateral tread plane of the wheels cannot be supported by the notches of the transversal rail gaps. Therefore, eliminating the notches of the transversal rail gaps at the steel rail joints is the key to solve the impact problem between the wheels and the steel rails.

If the transversal right-angled cutting of the two ends of the steel rails (the cutting plane at the steel rail end is perpendicular to the bottom plane of the steel rail and the longitudinal axis of the steel rail) is changed to bevel cutting (the cutting plane at the steel rail end is perpendicular to the bottom plane of the steel rail, but not perpendicular to the longitudinal axis of the steel rail), it is possible to convert the transversal rail gaps at the of the steel rail joints into bevel rail gaps (the rail gaps between the steel rails are not perpendicular to the longitudinal axis of the steel rails), so that the transversal through notches on the steel rail plane at the steel joints can be eliminated, the lateral tread plane of the wheel will not fall downwards when it passes across the rail plane where the bevel-end steel rail joints are cross-connected, and thus the impact between the wheels and the steel rail gaps can be eliminated!

In order to ensure that all wheels can smoothly pass through the bevel steel rail joints, it is also necessary to ensure smooth and unimpeded rail planes at the bevel rail gaps. Therefore, the type, specification, material of the steel rails on the bevel railway and the cutting angle of the adjacent bevel rails must be the same. The adjacent bevel-end steel rails must also be cross-connected and fixed on the same plane and along the same longitudinal axis.

In summary, changing the flat ends at both ends of the steel rail into cross-connected and coupled bevel ends can convert the transversal rail gaps at the steel rail joints into bevel rail gaps, which can eliminate transversal rail gap notches on rail planes at the steel rail joints, so that the lateral tread plane of the wheel will not fall downwards when passing across the rail plane of the bevel rail, the impact between the wheels and the steel rails can be eliminated!

② Force Transfer Process at the Bevel Steel Rail Joint

Figure 2:
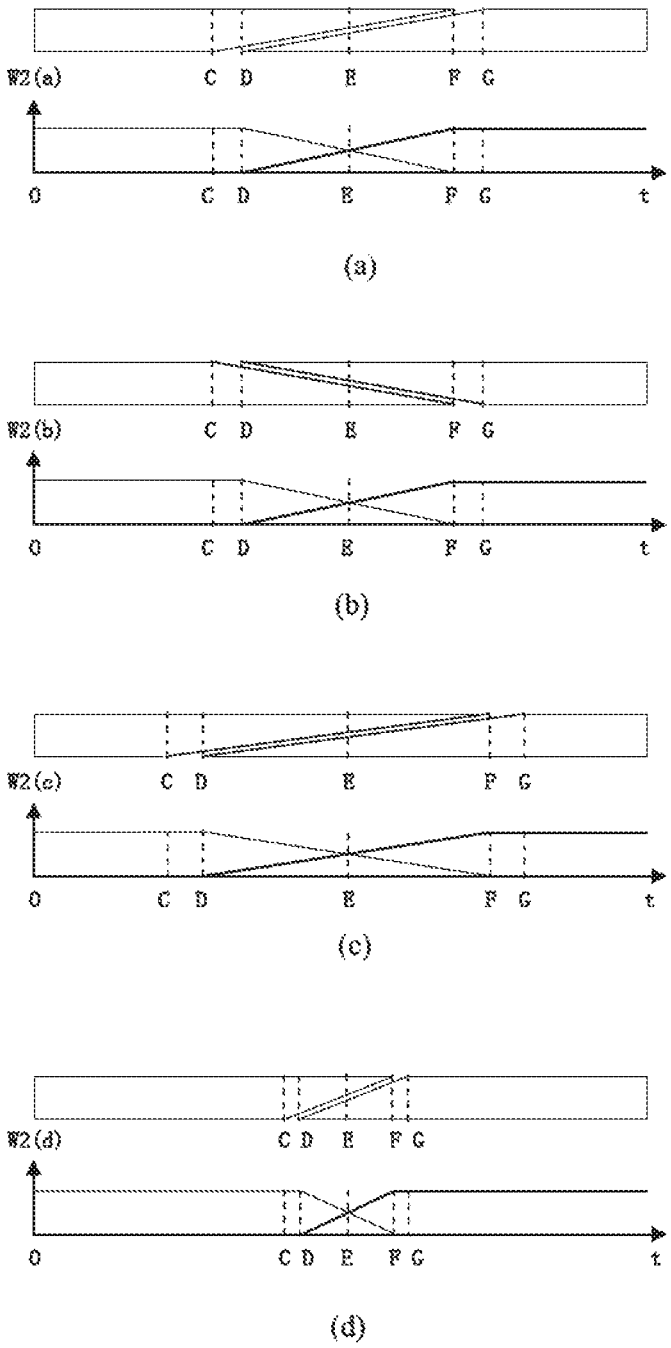

The force transfer process at the bevel steel rail joint is shown in FIG. 2.

FIG. 2 consists of the four sets of sub diagrams of FIG. 2(*a*), FIG. 2(*b*), FIG. 2(*c*) and FIG. 2(*d*). The four sets of sub diagrams each comprises a top plan view of the rail plane at the bevel-end steel rail joint and a rectangular coordinate system corresponding thereto in the vertical direction.

In the four sets of sub diagrams, although the cutting angle of the bevel-end steel rail (the minimum angle between the cutting surface of the steel rail end and the longitudinal axis of the steel rail) and the cutting direction are not the same, in order to compare the research results, in the top plan views of the rail plane at the four bevel-end steel rail joints, point D is the end point of the bevel rail on the right side of the bevel-end steel rail joint, point E is the center point of the bevel-end steel rail joint, and point F is the end point of the bevel rail on the left side of bevel-end steel rail joint, between points C and G is a joint area between the two bevel-end steel rails, and between points D and F are the coincident areas and the simultaneous force-carrying areas of the two bevel-end steel rails.

In the four sets of sub diagrams, the rectangular coordinate systems respectively corresponding to the top plan views of the steel rail plane in the vertical direction are the force transfer processes of the two bevel-end steel rails at the bevel-end steel rail joint, where the thinner solid lines are the process of force on the left bevel-end steel rail at the bevel-end steel rail joint, the thicker solid lines are the process of force on the right bevel-end steel rail at the bevel-end steel rail joint. In order to facilitate comparison of the research results, the wheels are assumed to pass the bevel-end steel rail joint in the four sets of sub diagrams under the same stress and at the same speed. The vertical axis W2 in the rectangular coordinate system represents the magnitude of the steel rail force, and the transversal axis t represents the time.

In the four sets of sub diagrams, the cutting angles of the bevel-end steel rails in FIG. 2(*a*) and FIG. 2(*b*) are the same, and the cutting directions thereof are opposite to each other. The bevel-end steel rails in FIG. 2(*a*) are cut with a counterclockwise small acute angle (with reference to the longitudinal axis of the steel rail). The bevel-end steel rails in FIG. 2(*b*) are cut with a clockwise small acute angle (with reference to the longitudinal axis of the steel rail). Comparing the force transfer processes of the bevel-end rails in FIG. 2(*a*) and FIG. 2(*b*), it is known whether the force transfer process at the bevel-end steel rail joint is affected by the change of the cutting direction at the bevel-end steel rail joint, and whether the bevel-end steel railway has two-way passage capacity.

In the four sets of sub diagrams, the bevel-end steel rails in the three sets of sub diagrams of FIGS. 2(*a*), 2(*c*) and 2(*d*) are cut with counterclockwise acute angles (with reference to the longitudinal axis of the steel rail), but the cutting angles of the bevel-end rail in the three sets of sub diagrams are different, in which the cutting angle of the bevel-end rail in FIG. 2(*d*) is the largest, and the cutting angle of the bevel-end rail in FIG. 2(*a*) is intermediate, and the cutting angle of the bevel-end steel rail in FIG. 2(*c*) is the smallest. By comparing the force transfer processes of the bevel-end steel rails in FIG. 2(*a*), FIG. 2(*c*) and FIG. 2(*d*), it is known whether the cutting angle of the bevel-end steel rail has a influence on the force transfer process at the bevel-end steel rail joint.

A. The Force Transfer Process at the Bevel-End Steel Rail Joint

In the following, taking FIG. 2(*a*) as an example, the force transfer process of the bevel-end steel rail joint is analyzed:

In FIG. 2(*a*): Before the wheel reaches the point D at the bevel-end steel rail joint, the pressure of the wheel is entirely borne by the left bevel-end steel rail. When the wheel enters the area between a section DE of the bevel-end steel rail joint, the main pressure of the wheel is still borne by the left bevel-end steel rail, and gradually transitions and transfers to the right bevel-end steel rail. When the wheel reaches the center point E of the bevel-end steel rails, the two overlapped bevel steel rails are loaded at the same time and each bear half of the wheel pressure. When the wheel enters the EF section at the bevel-end rail joint, the pressure of the wheel is gradually transitioned and transferred from being evenly borne by the two bevel-end steel rails to being mainly borne by the right bevel-end steel rail. Finally, when the wheel passes on the point F at the bevel-end steel rail joint, the wheel pressure has all been transferred to the right bevel-end steel rail.

From the rectangular coordinate system in FIG. 2(*a*), it can be seen that during the process of the wheel travelling from the point D to the point F at the bevel-end steel rail joint, the force applied to the left bevel-end steel rail gradually and linearly decreases from the entire wheel pressure to zero, and the force applied to the right bevel-end steel rail gradually and linearly increases from zero to the entire wheel pressure. The resultant force exerted by the wheel pressure on the adjacent two bevel-end steel rails is linear and stable. Therefore, no impact and vibration will occur between the wheel and the bevel-end rail joint.

Based on the same method, the force transfer process of the adjacent bevel-end steel rails at the bevel-end steel rail joint can be marked on the rectangular coordinate system in the other three sets of sub diagrams, as shown in FIG. 2(*b*) and FIG. 2 (*c*) and FIG. 2(*d*). Since the force transfer processes of the bevel-end steel rail in the three sets of sub diagrams are substantially the same as FIG. 2(*a*), the description will not be repeated hereafter.

B. Comparison and Analysis of the Force Transfer Process at the Bevel-End Steel Rail Joint when the Cutting Angles are the Same while the Cutting Directions of the Bevel Ends are Opposite for the Bevel-End Steel Rails Comparing FIG. 2(*a*) with FIG. 2(*b*), it can be seen that when the cutting angles of the bevel-end steel rails are the same and the cutting directions of the bevel ends are opposite, the force transfer process of the two bevel-end steel rails at the bevel-end steel rail joints take place in the coincident region of the bevel ends of the two bevel-end steel rails. The force transfer processes of the two bevel-end steel rails remain linear, the resultant forces exerted by the wheel pressure on the two bevel-end steel rails are linear and stable, and the force transfer processes and the force magnitudes on the bevel-end steel rails are all the same. Therefore, the force transfer process at the bevel-end steel rail joint is independent of the cutting direction of the bevel-end steel rail.

Since the force transfer process at the bevel-end steel rail joint is independent of the cutting direction of the bevel-end steel rail, the change of the travelling direction of the train does not affect the force transfer process at the bevel-end steel rail joint. Therefore, the bevel-end steel railways have two-way passage capacity.

C. Comparison and Analysis of the Force Transfer Process at the Bevel-End Steel Rail Joint when the Cutting Directions of the Bevel Ends are Substantially the Same while the Cutting Angles are Different for the Bevel-End Steel Rails Comparing the three sets of sub diagrams of FIG. 2(*a*), FIG. 2(*c*) and FIG. 2(*d*) can be seen: when the cutting directions of the bevel ends are substantially the same while the cutting angles are different for the bevel-end steel rails, the force transfer process of the two bevel-end steel rails at the steel rail gaps occurs in the cross-connected overlapped area of the two bevel-end steel rails. The force transfer processes of the two bevel-end steel rails remain linear and the force magnitudes on the two bevel-end steel rails are exactly the same. The resultant forces exerted by the wheel pressure on the two bevel-end steel rails are linear and stable, so no impact or vibration will occur between the wheel and the bevel-end rail joints. However, as the cutting angles of the bevel-end steel rails gradually decrease from large to small (the minimum angles between the cutting surfaces of the steel rail ends and the longitudinal axes of the steel rails change from large to small), the durations of the force transfers between the two bevel-end steel rails gradually increase, and the linear variation rate of the force magnitudes will gradually decrease. Therefore, the force transfer processes at the bevel-end steel rail joints are related to the cutting angles of the bevel-end steel rails. The durations of the force transfers of the bevel-end steel rail joints are inversely proportional to the cutting angles of the bevel-end steel rails, and the linear variation rate of the force magnitudes are proportional to the cutting angles of the bevel-end steel rails.

D. Comparison and Analysis of the Force Transfer Processes at the Bevel-End Steel Rail Joints when Stressed Width of the Rail Planes of the Bevel-End Steel Rails and the Stressed Regions Change for the Bevel-End Steel Rails If the train travels on two railways of different types, or when the wheel tread plane widths of the front and the compartment of the train are different, or the extents of wear and abrasion of the wheel tread planes of different compartments, the widths of the rail planes change or the positions of the stressed areas change.

At bevel-end steel rail joints where the stressed width of the rail planes of the bevel-end steel rails and the stressed regions change, the force transfer processes of the adjacent bevel-end steel rails occur in a strip-like extension on the rail planes that are in effective contact with the lateral tread plane of the wheels, particularly in the coincident sections of the two bevel-end steel rails bevel on the strip extension surface. The actual results are equivalent to the results in the case that the cutting angles of the bevel-end steel rail are the same but the widths of the rail planes vary or the case that the cutting angle of the bevel-end steel rail are the same but the position of the bevel-end steel rail joints vary. Therefore, according to the same analysis method as in FIG. 2, the force transfer process at the joints of the bevel-end steel rails are compared and analyzed in the case that the cutting angles of the bevel-end steel rail are the same but the widths of the rail planes vary or the case that the cutting angle of the bevel-end steel rail are the same but the position of the bevel-end steel rail joints vary.

When the cutting angles of the bevel-end rails are the same and the stressed widths in the rail plane are changed (the comparison chart of the force transfer processes is omitted), the resultant forces of the two bevel-end steel rails receiving the wheel pressure at the bevel-end steel rail joints are linear and stable, and no impact between the wheels and the bevel-end steel rails at the joints will occur. Moreover, the durations of force transfer at the bevel-end steel rail joints are proportional to the stressed widths in the rail plane, and the linear variation rates of the forces on the bevel-end steel rails are inversely proportional to the stressed widths in the rail plane.

When the cutting angles of the bevel-end rails are the same and the stressed widths in the rail plane are the same, the positions of the stressed areas are changed (the comparison diagram of the force transfer process is omitted), the resultant forces of the two bevel-end steel rails receiving the wheel pressure at the bevel-end steel rail joints are linear and stable, and no impact between the wheels and the bevel-end steel rails at the joints will occur. When the position of the stressed areas on the rail planes are laterally displaced due to the bevel-end steel rail joints between the steel rails, the initial position at which the wheel tread planes contact with the bevel-end steel rails will be longitudinally displaced in the rail plane, and the initial position (time) of the force transfer of the bevel-end steel rail will also be advanced or delayed. The initial position (time) of the force transfer of the bevel-end steel rail joint is dependent on the direction and size of the displacement of the stressed area, the direction and angle of the bevel end of the steel rail, the travelling direction and speed of the train.

In summary, the change of the stressed width of the steel rail plane and the change of the position of the stressed region do not affect the impact prevention performance of the bevel-end steel rail joint. The change of the stressed width of the steel rail plane and the change of the position of the stressed region are limited by the rail width, and has little influence on the duration of the force transfer, the linear variation rate of the force, and the initial position of the force transfer. The bevel-end steel railway has good passage capacity.

Based on the above, conclusion 1 is summed up as follows:

(1) The transversal right-angle cutting at both ends of the steel rail is changed to be bevel-end cutting, and the transversal rail gap at the steel rail joint can be converted into a bevel-end steel rail joint. When the wheel passes on the bevel-end steel rail joint, the bevel-end steel rail joint can ensure the gradual and steady transition of the linear load-bearing process of the adjacent two bevel-end steel rails, and the resultant force borne by the adjacent two bevel-end steel rails is always linear and stable, so that there will be no impact or vibration between the wheels and the bevel-end steel rail joints.

(2) The force transfer process at the bevel-end steel rail joint is independent of the cutting direction of the bevel-end steel rail, and the bevel-end steel rail has a two-way passage capacity.

(3) The force transfer process at the bevel-end steel rail joint is related to the cutting angle of the bevel-end steel rail; the duration of the force transfer at the bevel-end steel rail joint is inversely proportional to the cutting angle of the bevel-end steel rail, the linear variation rate of force on the bevel-end steel rail is proportional to the cutting angle of the bevel-end steel rail.

(4) The change of the stressed width of the steel rail plane and the change of the position of the stressed area do not affect the wheel-rail impact prevention performance of the bevel-end steel rail joint, and the bevel-end steel railway has good passage capacity.

2. Solution of the Problem of Thermal Stress on the Steel Rail

The bevel-end steel railway adopts the design of reserved longitudinal rail gap to solve thermal stress problem of the steel rails.

A longitudinal rail gap with a certain width is provided between adjacent bevel-end steel rails for bevel-end steel railway, and when the length of the bevel-end steel rails expands and contracts with temperature, they can expand and contract freely in the reserved longitudinal rail gap, which allows thermal stress of the steel rails to be completely released. Since there is no welding but a longitudinal rail gap between the bevel-end steel rails, of course there will be no problems of rail fracture and rail expansion. Therefore, the bevel-end steel railway can solve the problem of thermal stress of the steel rail without any potential risk.

The use of reserved longitudinal rail gap design does not require the restriction and locking of steel rails, which can completely eliminate potential safety hazards and can also reduce the cost of railway construction in times.

3. Optimization Design of the Cutting Angle of the Steel Rail

We know that the force transfer process at the bevel-end steel rail joint is related to the cutting angle of the bevel-end steel rail. Therefore, it is necessary to further study to what extent that the variation of the cutting angle of the steel rail can have influence on wheel-rail impact prevention performance and thermal stress adjustment performance of the bevel-end steel railway.

Since the force transfer process at the bevel-end steel rail joint has nothing to do with the cutting direction of the bevel-end steel rail, in order to facilitate the comparative study, in this paper, except for special indications, the counterclockwise acute angle θ between the cutting surface of the steel rail and the longitudinal axis of the steel rail is used as the cutting angle of the steel rail.

(1) Influence of Rail Cutting Angle on Impact Prevention Performance

Figure 3:
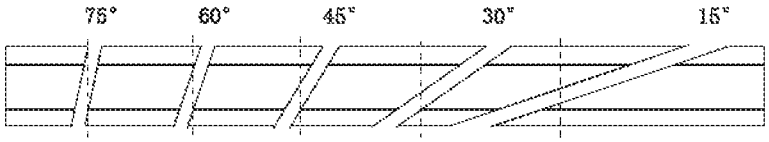

FIG. 3 is a top plan view of the bevel-end steel rail joint with the bevel end being cut with five acute cutting angles.

As can be seen from FIG. 3:

① When the width of the reserved bevel-end rail gap of the steel rails is the same, if the cutting angle (between 0° and 90°) of the steel rails gradually decreases from large to small, the notch length of the transversal rail gap formed in the rail plane (the region enclosed by the black thick lines) at the steel rail joint will also gradually decrease from long to short (as indicated by the blank areas of the rail gap passing through by the dashed lines), and the probability of forming a transversal through notch in the rail plane at the steel rail joint is also getting smaller and smaller. The probability of impacts between wheel and steel rail gaps is getting lower and lower.

② The larger the cutting angle of the bevel-end steel rail (between 0° and 90°) is, the greater the influence of the width change of the reserved rail gap of the bevel-end steel rail on the change of the length of the transversal notch of the steel rail gap is. The smaller the cutting angle of the steel rail is, the smaller the influence of the width change of the reserved rail gap of the bevel-end steel rail on the change of the length of the transversal notch of the steel rail gap is.

Figure 4:
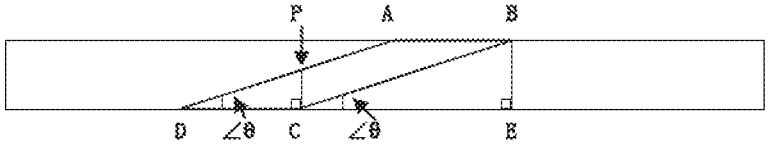

The exact relationship between the cutting angle of the bevel-end steel rail and the length of the transversal notch of the steel rail gap is shown in FIG. 4.

FIG. 4 is a top plan view of the rail plane at the bevel-end steel rail joint. In FIG. 4, ∠θ is the cutting angle of the bevel-end steel rail, the line segment AB and the line segment DC are the widths of the reserved longitudinal rail gap between the two bevel-end steel rails at the bevel-end steel rail joint, the line segment BE is the width of the steel rail plane of the bevel-end steel rail (head width of the steel rail), and the line segment PC (perpendicular to the line segment DC) is the width of the transversal notch at the bevel-end steel rail joint.

In the right angle ΔPCD, ∠PDC=∠θ is the cutting angle of the bevel-end steel rail, the line segment DC is the width of the longitudinal rail gap between the bevel-end steel rails, and the line segment PC is the width of the transversal notch between the bevel-end steel rails. According to the trigonometric function definition, the relationship between DC, PC and ∠θ is:

$$\tan\theta = PC\ (\text{width of the transversal notch})/DC\ (\text{width of the longitudinal rail gap}) \quad \text{Formula (1):}$$

By modification of formula (1), it is obtained:

$$PC\ (\text{width of the transversal notch}) = \tan\theta \times DC\ (\text{width of the longitudinal rail gap}) \quad \text{Formula (2):}$$

$$DC\ (\text{width of the longitudinal rail gap}) = PC\ (\text{width of the transversal notch})/\tan\theta \quad \text{Formula (3):}$$

We know that tan θ>0 when 90°>θ>0° and tan θ>1 when 90°>θ>45°.

From formula (2), it can be seen:

① When 90°>θ>45°, since the tan θ>1, the variation of the width of the longitudinal rail gap (DC) has a large influence on the variation of the length of the transversal notch (PC). If a large acute angle (90°>θ>45°) is selected for the bevel-end steel rail, although the impact between wheels and rails can also be eliminated by reducing the width of the reserved longitudinal rail gap, but this will lead to a significant decline in thermal stress adjustment capability of the steel railway, and only rails with shorter lengths can be used. In this case, bevel-end steel railways can only work in areas where the temperature difference is smaller.

① When 45°>θ>0°, since tan θ<1, the influence of variation of the width of the longitudinal rail gap (DC) on the variation of the length of the transversal notch (PC) is small. In the range of 45°>θ>0°, as the ∠θ gradually decreases, the width of the transversal rail gap (PC) also rapidly becomes smaller as the tangential value becomes significantly smaller, and the probability of impact between wheels and the steel rail gaps decreases rapidly. This is the fundamental reason why small acute angle bevel-end steel rails are used for bevel-end steel railway.

From formula (3), it can be seen that when the width of the transversal rail gap (PC) is constant, if the cutting angle (θ) of the bevel-end steel rail is smaller, the width of the longitudinal rail gap (DC) will become significantly larger as the tangent value becomes significantly smaller. In other words, under the premise of ensuring that no impact between wheels and rails would occur (PC<BE), if the cutting angle of the bevel-end steel rail is smaller, the influence of the change of the width of the longitudinal rail gap on the change of the length of the transversal notch is smaller.

As we know, in the normal situation after the completion of the steel railway, the change in the width of the longitudinal rail gap is caused by thermal expansion and contraction of the steel rail, if the change of the width of the longitudinal rail gap of the bevel-end steel rail has a smaller influence on the change of the length of the transversal notch, the change of temperature would have a smaller influence on the prevention performance of bevel-end steel railways of impact between wheels and rails, and the temperature difference range for normal operation of the bevel steel railway is even greater.

Base on the above, conclusion 2 is summed up as follows:

The smaller the cutting angle of the bevel-end steel rail (the smaller the minimum angle between the cutting surface of the steel rail end and the longitudinal axis of the steel rail) is, the better the wheel-rail impact prevention performance of the bevel-end steel railway is, the better thermal stress adjustment performance is, and the greater the range of temperature difference for normal operation is.

(2) The Relationship Between the Cutting Angle of the Steel Rail and Thermal Stress Bevel-end steel railway uses longitudinal rail gaps to release thermal stress of the steel rail, and the change of the width of the reserved rail gap directly affects the ability of the steel railway to release thermal stress. Therefore, it is necessary to further study the relationship between the cutting angle of the bevel-end rail and the bevel-end steel rail gap.

Figure 5:
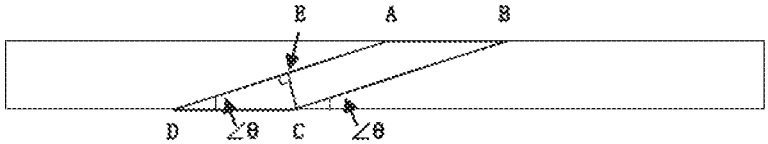

The relationship between the bevel-end steel rail cutting angle and the bevel-end steel rail gap is shown in FIG. 5.

FIG. 5 is a top plan view of the steel rail plane at the bevel-end steel rail joint. In FIG. 5, the oblique sides of the two bevel-end steel rails at the bevel-end steel rail joint and the reserved rail gap form a parallelogram ABCD. The line segment AB and the line segment DC are the longitudinal widths of the reserved rail gaps between the two bevel-end steel rails. The line segment CE is the height of the parallelogram ABCD, and is also the width of the bevel rail gap at the bevel-end steel rail joint.

In the parallelogram ABCD, since the line segment CE is the height of the parallelogram ABCD, a right angle ΔCED is formed. In the right angle ΔCED, ∠CDE=∠θ is the cutting angle of the bevel-end steel rail, the line segment DC is the longitudinal width of the reserved rail gap between two bevel-end steel rails, and the line segment CE is the height of the parallelogram ABCD and is also the width of the bevel rail gap at the bevel-end steel rail joint. According to the triangular function definition, the relationship between DC, CE, and ∠θ is:

$$\sin\theta = CE\ (\text{width of the bevel rail gap})/DC\ (\text{width of the longitudinal rail gap}) \quad \text{Formula (4):}$$

By modification of formula (4), it is obtained:

$$CE\ (\text{width of the bevel rail gap}) = \sin\theta \times DC\ (\text{width of the longitudinal rail gap}) \quad \text{Formula (5):}$$

$$DC\ (\text{Width of the longitudinal rail gap}) = CE\ (\text{width of the bevel rail gap})/\sin\theta \quad \text{Formula (6):}$$

We know that when ∠θ varies from 0° to 90°, the sine value also changes from 0 to 1. Further, the sine value increases (or decreases) as ∠θ. increases (or decreases).

It can be seen from the formula (5) that when the width of the longitudinal rail gap (DC) is constant, as the ∠θ gradually becomes smaller, the width of the bevel rail gap (CE) also becomes smaller in times (multiplier equals to value of sin θ) due to significant decreasing of the sine value.

It can also be calculated by using formula (5) that as the ∠θ becomes smaller gradually, the influence of the variation of the width of the longitudinal rail gap on the width of the bevel rail gap also becomes significantly smaller.

For example, when θ=30°, if the width of the longitudinal rail gap (DC) varies by ±10 mm, the width of the bevel rail gap (CE) can only vary by ±5 mm, and the steel railway's ability to adjust thermal stress is twice that of the original. When θ=15°, if the width of the longitudinal rail gap (DC) varies by ±10 mm, the width of the bevel rail gap (CE) can only vary by ±2.59 mm, and the steel railway's ability to adjust thermal stress is 3.86 times that of the original. When θ=10°, if the width of the longitudinal rail gap (DC) varies by ±10 mm, the width of the bevel rail gap (CE) can only vary by ±1.74 mm, and the steel railway's ability to adjust thermal stress is 5.75 times that of the original.

We know that in the normal situation after the completion of the steel railway, the width of the longitudinal rail gap is caused by the thermal expansion and contraction of the steel rail, the smaller the influence of the width variation of the longitudinal rail gap of the steel rail on the width variation of the bevel rail gap, the better thermal stress adjustment performance of the steel railway is. The width of the bevel-end steel rail joint decreases as the cutting angle of the steel rail becomes significantly smaller, which can multiply thermal stress adjustment performance of the bevel-end steel railway, enabling the bevel-end steel railway to operate normally in areas having great temperature differences.

It can be seen from the formula (6) that when the width of the bevel rail gap (CE) is constant, the width of the longitudinal rail gap (DC) gradually becomes larger as ∠θ becomes smaller (the sine value also becomes smaller and smaller). In other words, if the cutting angle of the bevel-end steel rail is smaller, under the premise of ensuring that the wheel-rail impact and rail expansion do not occur, the width of the reserved longitudinal rail gap between the bevel-end steel rails can be larger, so that the bevel-end steel railway can operate normally in areas having great temperature differences.

Calculating with the longitudinal rail gap of a standard steel railway of approximately 6 mm, when the steel rail cutting angle θ=15°, the width of the bevel rail gap between the bevel-end steel rails is only 1.554 mm, and the steel rail plane at the steel rail gap is almost integrated. Calculating with the longitudinal rail gap of a bevel-end steel railway of approximately 11 mm, when the steel rail cutting angle θ=15°, the width of the bevel rail gap between the bevel-end steel rails is only 2.849 mm, and the steel rail plane at the steel rail gap is almost the integrated. Therefore, the smaller the cutting angle of the bevel-end steel rail is, the smoother and more complete the rail plane of the steel rail is, the smaller the running resistance, vibration and noise of the train are, and the faster, smoother, quieter and more energy-efficient the train travels.

The width of the bevel rail gap at the bevel-end steel rail joint is reduced in times with a significant reduction in the cutting angle of the bevel-end steel rail, which multiplies thermal stress adjustment performance of the bevel-end steel railway so that the bevel-end steel railway can operate normally in areas having great temperature differences. It also improves the smoothness and completeness of the rail plane at the bevel-end steel rail joint, and thus significantly reduces the running resistance and vibration of the train. It further reduces the width stay of longitudinal rail gaps of design as long as the need of thermal stress adjustment is satisfied, which further improves the smoothness and integrity of the rail plane at the joint of the bevel-end rail and reduces running resistance and vibration of the train, thus creating conditions for the further speed increase and energy saving of the steel railway.

Base on the above, conclusion 3 is summed up as follows:

The smaller the cutting angle of the bevel-end steel rail is, the better the thermal stress adjustment performance of the bevel-end steel railway is, enabling it to operate normally in areas having great temperature differences. The smaller the cutting angle of the bevel-end steel rail is, the smoother and more complete the rail plane at the bevel-end steel rail joint is, and the smaller the running resistance, vibration and noise of the train are, which can further increase the speed and driving stability and reduce energy consumption.

(3) Cutting Angle of the Steel Rail and Length of the Bevel End

Each end of a bevel-end steel rail has two bevel ends: one is the bevel end of the steel rail, and the other is the bevel end of rail plane of the steel rail.

Figure 6:
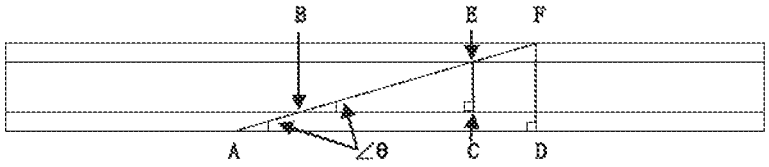

The relationship between the cutting angle θ of the bevel-end steel rail and the length of the two bevel ends is shown in FIG. 6.

FIG. 6 is a top plan view of the steel rail. In FIG. 6, ∠θ is a cutting angle of a bevel-end steel rail, AD is the length of the bevel end of the bevel-end steel rail, FD is the bottom width of the bevel-end steel rail, AF is the length of the oblique edge of the bevel-end steel rail, BC is the length of the bevel end of the rail plane, EC is the width of the rail plane (head width of the steel rail), and BE is the length of the oblique edge of the rail plane.

In the right angle ΔFDA, ∠θ is the cutting angle of the bevel-end steel rail, FD is the bottom width of the bevel-end steel rail, and AD is the length of the steel rail bevel end. According to the trigonometric function definition, the relationship between AD, FD and ∠θ is:

$$\tan\theta = FD\ (\text{bottom width of the bevel-end steel rail})/AD\ (\text{length of the steel rail bevel end}) \qquad \text{Formula (7):}$$

By modification of formula (7), it is obtained:

$$AD\ (\text{length of the steel rail bevel end}) = FD\ (\text{bottom width of bevel-end rail})/\tan\theta \qquad \text{Formula (8):}$$

Similarly, in the right angle ΔECB, ∠θ is the cutting angle of the bevel-end steel rail, BC is the length of the bevel end of the rail plane of the steel rail, and EC is the rail head width of the steel rail (width of the rail plane of the steel rail). According to the trigonometric function definition, the relationship between BC, EC, and ∠θ is:

$$\tan\theta = EC\ (\text{head width of the steel rail})/BC\ (\text{length of the bevel end of the rail plane}) \qquad \text{Formula (9):}$$

By modification of formula (9), it is obtained:

$$BC\ (\text{length of the bevel end of the rail plane}) = EC\ (\text{head width of the steel rail})/\tan\theta \qquad \text{Formula (10):}$$

After the model and the cutting angle of the steel rail, the length of the steel rail bevel end and the length of the bevel end of the rail plane can be calculated according to formulas (8) and (10), respectively. If it is necessary to calculate the length of the oblique edge of the bevel-end steel rail and the length of the oblique edge of the rail plane of the bevel-end rail, the calculation formulas can be obtained separately according to FIG. 6 and the trigonometric function definition.

(4) Optimized Selection of Cutting Angle of the Bevel-End Steel Rail

The selection of the cutting angle of the bevel-end steel rail has great influences on the wheel-rail impact prevention performance and thermal stress adjustment performance of the bevel-end steel railway, and also affects the processing, transportation and installation of the bevel-end steel rails.

According to conclusions 2 and 3, if the cutting angle of the bevel-end steel rail is smaller, the wheel-rail impact prevention performance and thermal stress adjustment performance of the bevel-end steel railway are better, the normal operation temperature difference range is larger, the resistance, vibration and noise of the running train are smaller, and the speed and driving stability can be further improved. Therefore, from the perspective of the technical performance of the steel railway, a smaller cutting angle of the bevel-end rail is preferred. However, if the cutting angle of the bevel-end steel rail is too small, the length of the bevel end of the bevel-end steel rail will be significantly increased, which will increase the difficulties in production and coupling and connecting of the bevel-end steel rails, and will also increase damage probability during the production, transportation and installation of the bevel-end steel rail, leading to increase in production, transportation and installation costs.

After an optimized demonstration, the cutting angle of the bevel-end steel rail is set to 15° (the minimum angle between the cutting surface of the steel rail end and the longitudinal axis of the steel rail is 15°), which can not only enable the bevel-end steel railway to have excellent wheel-rail impact prevention performance and thermal stress adjustment performance, but can also reduce the difficulty of processing bevel-end steel rails, the difficulty of coupling and fixing, and the reject rate. These can ensure excellent technical performance and overall benefits of the bevel-end steel railway.

(5) Optimized Selection of Bevel-End Rail Cutting Mode

The design of bevel-end steel rail joint is achieved by ying the flat ends at both ends of the steel rail to bevel ends. Since the force transfer process at the bevel-end steel rail joint is independent of the cutting direction of the bevel-end steel rails, in order to make a bevel rail gap design, bevel-end steel rails may have a variety of cutting directions, a variety of cutting methods, a variety of cutting angles and a variety of combinations thereof.

If the bevel-end steel railway adopt a parallel rail gap design, the bevel-end steel railway can be made using the bevel-end steel rails which have parallel cutting planes at both ends (the steel rails are parallelograms in top plan views), are cut clockwise with acute angles (based on the longitudinal axis of the steel rail) and have the same cutting angles. Also, the bevel-end steel railway can be made using the bevel-end steel rails which have parallel cutting planes at both ends (the steel rails are parallelograms in top plan views), are cut counterclockwise with acute angles (with reference to the longitudinal axis of the steel rail) and have the same cutting angles. Further, the bevel-end steel railway can also be made in accordance with the above two cutting methods, respectively, by change the acute cutting angles, and then forming more kinds of bevel-end steel rails which have parallel and clockwise acute angled rail gaps (with reference to the longitudinal axis of the steel rail) or differently angled and counterclockwise acute angled rail gaps.

If the bevel-end steel railway adopt a non-parallel rail gap design, the bevel-end steel rails which have the same cutting angles and are cut clockwise and acute angled and counterclockwise and acute angled respectively (the steel rails are isosceles trapezoids in top plan views) are overturn to form the bevel-end steel railway having non-parallel rail gaps. Alternatively, the same method may be adopted, but the acute cutting angles are changed to form more kinds of bevel-end steel railways having non-parallel rail gaps. Alternatively, the same cutting angles of the steel rails may be selected, the two ends of the steel rails are parallelly cut with clockwise (with reference to the longitudinal axis of the steel rail) acute angles (the steel rails are parallelograms in top plan views), parallelly cut with counterclockwise (with reference to the longitudinal axis of the steel rail) acute angles (the steel rails are also parallelograms in top plan views), or parallelly cut respectively with clockwise acute angles and with counterclockwise (with reference to the longitudinal axis of the steel rail) acute angles (the steel rails are isosceles trapezoids in top plan views), and the three kinds of bevel-end steel rails having the same cutting angles but different cutting methods are combined to form relatively complicated bevel-end steel railways. Alternatively, the three cutting methods may be adopted, the acute cutting angles of the steel rails may be changed, and the three steel rails may be combined in alternative to form more kinds of bevel-end steel railways having different rail gap angles. Alternatively, bevel-end steel rails having different cutting angles and cut in different cutting methods and in different cutting directions may be selected and combined to form more complicated bevel-end steel railways.

Although bevel-end steel rails may have a variety of design choices with different cutting directions, cutting methods, cutting angles and combinations, but only the bevel-end steel rails having parallel cutting planes at both ends do not require turning around for seam butting during laying and replacement of the steel rails. Further, the bevel-end steel rails having parallel cutting planes at both ends can also simplify the processing of the bevel end, facilitating fast and continuous production of the bevel-end steel rails. Therefore, adopting the bevel-end steel rails having parallel cutting planes at both ends can not only avoid unnecessary troubles in the production, laying and replacement of the bevel-end steel rails, but also can significantly improve production efficiency and laying efficiency and reduce overall costs.

After optimization and verification, the processing standard of the standard bevel-end steel rails is determined as follows: the cutting surfaces of the two ends of the steel rails are parallel, the cutting planes of the steel rails end are perpendicular to the planes where the rail bottom of the steel rail is located, and the angle between the steel rails and the longitudinal axis of the steel rail is 15° counterclockwise.

4. Universal Compatible Design of Bevel-End and Flat-End Steel Rails

In order to reduce the construction cost of bevel-end steel railways and the cost of renovation of existing flat-end railways, it is necessary to use compatible and complementary design of bevel-end and flat-end steel rails so as to minimize waste of the huge amount of money that has been invested in the steel railways.

Compatible and complementary design of bevel-end and flat-end steel rails includes a structural compatible design, a length compatible and complementary design, and a bevel-end compatible design of standard bevel-end steel rails and standard steel rails.

(1) Structural Compatible Design

The reliability of standard steel rails has been verified for a long time. In order to ensure the safety and reliability of bevel-end steel railways, the bevel-end steel rails are designed to follow the structure design of the standard steel rails. Except for different lengths and end structures as compared with standard steel rails, the rest of the designs (models, specifications, structures, materials, and production standards) are the same as those of standard steel rails. The width of the head of the standard steel rail is greater than the thickness of the waist. After bevel cutting, the tip of the bevel head of the steel rail head must be suspended and protruded from the steel rail waist, and the suspended portion can no longer bear the weight. The steel rail of the standard steel rail has a symmetrical curved structure, and bevel cutting will inevitably lead to asymmetry of the rail waist structure and destruction of the load-bearing structure of the bevel end, which significantly reduces the anti-bending performance and load-bearing performance of the bevel end. Base on the above, conclusion 4 is summed up as follows: "After bevel cutting of the standard steel rails, the anti-bending performance and load-bearing performance at the bevel ends of the heads the steel rails are greatly reduced, and they cannot be safely used. To ensure the safe use of bevel-end steel rails, it is necessary to improve or strengthen the load-bearing structure the bevel ends." Structure design scheme for standard bevel-end steel rails: In order to completely solve the problems caused by bevel cutting, such as the suspension of the tip of the bevel-end of the steel rail head, declines of the anti-bending and the load-bearing performances of the bevel end, and at the same time, and to further improve the anti-bending and the load-bearing performances and structural strength of the bevel end, the standard bevel-end steel rail adopts the design that "the rail waist thickness is the same as the rail head width" at the bevel end. Renovation of standard steel rails into bevel-end steel rails scheme: To ensure that the bevel-renovated standard steel rails can be safely used for bevel-end steel railways, a widened, thickened "external rail waist type" (special-shaped) holder joint design must be employed. Since three side surfaces of the "external rail waist type" holder can be closely matched with the rail waist curve, the lower surface of the steel rail head and the upper surface of the steel rail bottom, and the plane on the outer side of the holder is of the same width as the side surface of the steel rail head, the "external rail waist type" holder functions to connect the steel rails and as external rail waist. Using the "external rail waist type" holder, the suspended portion of the bevel-end of the steel rail head can be effectively supported at the steel rail waist at both sides of the bevel-end steel rail joint, so that the suspended portion of the steel rail plane can be provided with balanced support structure (composed of the holder and the steel rail waist), which solves the load-bearing problem at the suspended portion of the steel rail plane. By using the "external rail waist type" holder to provide balanced support of the combined rail head at the steel rail waist portions at both sides of the bevel-end steel rail joint, the overall load-bearing performance and anti-bending performance of the bevel-end steel rail joints can be significantly improved, and the problems of deviation of wheel pressure and deterioration of load-bearing performance at the bevel end portion caused by bevel cutting can be effectively solved. By using the thickened and widened "external rail waist type" holder for combined joint of the two steel rail bevel ends on the two sides of the bevel-end steel rail joint, the structural strength and connection reliability of the bevel-end steel rail joints can also be improved. The use of "external rail waist type" (special-shaped) holder connection design can ensure the safe use of bevel renovated standard steel rails, and existing rails can be bevel renovated directly on the railway.

(2) Length Compatible and Complementary Design

The bevel-end steel railway has a superior thermal stress adjustment performance, the length design for the standard bevel-end steel rail has a wider range of options, and the length compatible and complementary design provides more flexibility.

Although the length design of the standard bevel-end steel rail has a wider range of options, if the length of the standard bevel-end steel rail is too long, manufacturing cost, transportation cost, laying equipment cost and labor cost of the steel rail will be increased. If the standard bevel-end steel rail is too short, the number of rail joints on the steel railway will be increased, which will increase the connection cost of the steel rail. The use of standard bevel-end steel rails with an appropriate length will not only facilitate the production, transportation, laying and replacement of steel rails, but also further reduce the width of the reserved longitudinal rail gap, which can further improve the smoothness of the steel rail plane at the joint of the bevel-end steel rail joints, and further reduce the running resistance and increase the vehicle speed. Therefore, the length design of standard bevel-end steel rails should be optimized taking various factors into account.

In view of the extensive use of standard steel rails with lengths of 25 meters and 12.5 meters for standard steel railway and seamless steel railway, steel rails with a length of 12.5 meters×N (N=1, 2, 4, 6, 8, 10) can be compatible with steel rails with lengths of 25 m and 12.5 m for length compatibility and interchangeability, which can meet thermal stress adjustment requirements for bevel-end steel railway. Furthermore, if the standard steel railways and seamless steel railways are directly renovated on the line, the ends of the standard steel rails need to be bevel cut, and the bevel ends of the adjacent rails are also cross-connected. The "flat-end into bevel-end renovated railway" will have a problem of vacant bevel ends. In order to make up for vacant bevel ends of the "flat-end into bevel-end renovated railway". The length of a single rail of the standard bevel-end steel rails should also be increased by the length of two bevel ends. Therefore, the length of the single rail of the standard bevel-end steel rails is designed to be (12.5×N+2a) meters [a is the length of the bevel end of the standard bevel-end steel rail, and N=1, 2, 4, 6, 8, 10], and by this design the requirements of length compatibility and interchangeability and bevel end complementation are satisfied.

After comprehensive consideration of railway performance, application scope, renovation requirement, production cost, transportation cost, ease of laying and the like, the ultimate effective length of the standard bevel-end rail is designed to be 25 meters, and the single rail length of the standard bevel-end rail is designed to be (25+2a) meters [a is the length of the bevel end length of a standard bevel-end steel rail].

"Effective length": In the bevel-end steel railway, the bevel ends at both ends of the standard bevel-end steel rails are cross-connected and longitudinal rail gaps needs to be reserved, and the bevel end length and rail plane bevel end length of different types of bevel-end steel rails are different, which result in more troublesome design and calculation of the length of the steel railway. By setting the length of the middle part of the various bevel-end steel rails with the bevel ends at two ends thereof removed to be the "effective length", the length of the railway can be calculated using the "effective length" and the cross-connected bevel ends as a unit, which simplifies length design and calculation of the Bevel-end steel railway. By setting the length of a single rail of the standard bevel-end rails, the rails are easy to produce and inspect. If the bevel end length of the standard bevel-end rail is denoted by a, the relationship between the length of a single rail and the "effective length" of the standard bevel-end steel rails is: the length of a single rail of the standard bevel-end steel rails=the effective length+2a, wherein if the "effective length" of the standard bevel-end steel rails is 25 meters, the length of a single rail of the standard bevel-end steel rails=(25+2a) meters.

Rails on standard steel railway and seamless steel railway are all flat-end rails. The "effective length" of steel rails is equal to the length of the steel rails. If the ends of standard steel rails are cut and converted to bevel ends, the "effective length" of "flat-end into bevel-end renovated rails"=(standard steel rail length−2a) meters [a is the bevel end length of the standard bevel-end steel rail].

In the construction of bevel-end steel railways and the renovation of various flat-end steel railways, the cross-connected joints of the bevel ends of the bevel-end steel railways and the different bevel end lengths and rail plane bevel end lengths of different types of bevel-end steel rails must be considered. When the length of the railway is calculated based on the "effective length" and cross-connected bevel ends of various bevel-end steel rails, the factor of reserved longitudinal rail gaps must also be taken into account to avoid problems of "rail fracture" and "rail expansion" in design.

In the construction of bevel-end steel railway, standard bevel-end steel rails should be used. In the case of "flat-end into bevel-end renovated railway" renovated by "partial interval replacement" or "interval replacement" methods, it is necessary to simultaneously use the same type of standard bevel-end steel rails [Length=(25+2a)m] and "flat-end into bevel-end renovated steel rails" [Length=(25−2a)m]. In the reconstruction of a bevel-end steel railway, either standard bevel-end steel rails or "flat-end into bevel-end renovated steel rails" can be used. As the bevel-end steel railway eliminates the impact between wheels and rails, the service life of the steel rails will be significantly prolonged. In a relatively long period of time, all kinds of "flat-end into bevel-end renovated railway" will use both the standard bevel-end steel rails and the "flat-end into bevel-end renovated steel rails".

(3) Bevel-End Compatible Design

On the basis of structure compatibility and length compatibility and complementation of standard bevel-end steel rails with standard steel rails, by cutting and ying the standard steel rails in accordance with the same bevel-end cutting standard for standard bevel-end steel rails, compatibility of standard steel rails and standard bevel-end steel rails can be realized.

By adopting compatible and complementary designs of flat-end rails and bevel-end rails, the existing equipments and techniques can be continually used for the production of standard bevel-end steel rails, standard steel rails can be continually used by "flat-end into bevel-end renovation", existing sleepers and line accessories can be fully employed, and also existing railways can be directly renovated on the line. In this way, the huge waste of previous investment caused by the replacement of steel rails, sleepers, line accessories and production equipment can be avoided, and huge reinvestment can also be avoided, which can achieve huge economical benefits.

By adopting compatible and complementary designs of flat-end rails and bevel-end rails, requirements of general compatibility and bevel-end complementation of standard bevel-end steel rails with "flat-end into bevel-end renovated steel rails" can be satisfied, and huge stock of existing standard steel railways and seamless steel railways can be renovated in accordance with "partial interval replacement" and "interval replacement" methods, which can lower the railway renovation cost in times (see page 19 for "partial interval replacement" and "interval replacement").

By adopting compatible and complementary designs of flat-end rails and bevel-end rails, various scrapped rail wastes can be reused. On flat-end railways, the main cause of scrapped rails is the steel rail end damage caused by the impact between wheels and rails (account for about 60% of the scrapped rails). Since the standard bevel-end steel rails are bevel cut with acute angles, if the scrapped standard steel rails with damaged ends are renovated into bevel-end steel rails, the flat ends of the scrapped steel rails are cut away, so that the scrapped standard steel rails are renovated into qualified bevel-end steel rails. During production, transportation and installation of the standard bevel-end steel rails, if bevel end damage occurs for the standard bevel-end steel rails with a length of (25+2a)m, these bevel-end steel rails can be re-cut in accordance with the specification of the length (25−2a)m, so that it is used for "flat-end into bevel-end renovated steel railway."

(b) Technical Features

Bevel-end steel railways have the following four apparent technical features.

1. The Minimum Angle Between the Bevel Rail Gap and the Longitudinal Axis of the Steel Rail at the Steel Rail Joint is Selected to be within the Range of $15° \leq \theta < 45°$.

Bevel-end steel railway uses the design of bevel-end steel rail joints, which can completely eliminate the impact between wheels and rails, and can also significantly improve thermal stress adjustment performance of the steel railway. If the minimum angle between the bevel rail gap and the longitudinal axis of the steel rail is smaller, the wheel-rail impact prevention performance and thermal stress adjustment performance of the bevel-end steel railway is better. If the minimum angle between the bevel rail gap and the longitudinal axis of the steel rail is larger, it is still possible to maintain the excellent performance of the Bevel-end steel railway by selecting a relatively shorter length for the bevel-end steel rail and adjusting the width of the longitudinal rail gap between the bevel-end steel rails [the centerline (parallel and the equidistant to both edge lines of the rail plane) of the rail plane of the steel rail has been set to the steel rail longitudinal axis].

Technical features of the bevel-end steel rail joint design: The minimum angle between the bevel rail gap and the longitudinal axis of the steel rail at the steel rail joint is selected to be within the range of $15° \leq \theta < 45°$.

By changing the transversal right-angle cutting of both ends of the steel rail into bevel cutting, the transversal rail gaps between the steel rails can be converted into bevel rail gaps, and the bevel rail gap joint design can be realized. Since the force transfer process at the bevel-end steel rail joint is independent of the cutting direction of the bevel-end steel rail, in order to realize the bevel-end steel rail joint between the steel rails, the bevel-end steel rails can have various cutting directions, cutting angles and combinations thereof. The bevel rail gap design of the bevel-end steel railway can also have a variety of directions, angles and combinations thereof.

If the bevel-end steel railway adopt a parallel rail gap design, the bevel-end steel railway can be made using the bevel-end steel rails which have parallel cutting planes at both ends (the steel rails are parallelograms in top plan views), are cut clockwise with acute angles (based on the longitudinal axis of the steel rail) and have the same cutting angles. Also, the bevel-end steel railway can be made using the bevel-end steel rails which have parallel cutting planes at both ends (the steel rails are parallelograms in top plan views), are cut counterclockwise with acute angles (with reference to the longitudinal axis of the steel rail) and have the same cutting angles. Further, the bevel-end steel railway can also be made in accordance with the above two cutting methods, respectively, by change the acute cutting angles, and then forming more kinds of bevel-end steel rails which have parallel and clockwise acute angled rail gaps (with reference to the longitudinal axis of the steel rail) or differently angled and counterclockwise acute angled rail gaps.

If the bevel-end steel railway adopt a non-parallel rail gap design, the bevel-end steel rails which have the same cutting angles and are cut clockwise and acute angled and counterclockwise and acute angled respectively (the steel rails are isosceles trapezoids in top plan views) are overturn to form the bevel-end steel railway having non-parallel rail gaps. Alternatively, the same method may be adopted, but the acute cutting angles are changed to form more kinds of bevel-end steel railways having non-parallel rail gaps. Alternatively, the same cutting angles of the steel rails may be selected, the two ends of the steel rails are parallelly cut with clockwise (with reference to the longitudinal axis of the steel rail) acute angles (the steel rails are parallelograms in top plan views), parallelly cut with counterclockwise (with reference to the longitudinal axis of the steel rail) acute angles (the steel rails are also parallelograms in top plan views), or parallelly cut respectively with clockwise acute angles and with counterclockwise (with reference to the longitudinal axis of the steel rail) acute angles (the steel rails are isosceles trapezoids in top plan views), and the three kinds of bevel-end steel rails having the same cutting angles but different cutting methods are combined to form relatively complicated bevel-end steel railways. Alternatively, the three cutting methods may be adopted, the acute cutting angles of the steel rails may be changed, and the three steel rails may be combined in alternative to form more kinds of bevel-end steel railways having different rail gap angles. Alternatively, bevel-end steel rails having different cutting angles and cut in different cutting methods and in different cutting directions may be selected and combined to form more complicated bevel-end steel railways.

Although bevel-end steel rails may have a variety of design choices with different cutting directions, cutting angles and combinations thereof, no matter what kind of bevel rail gap design is used, whether the bevel rail gap at the steel rail joint is counterclockwise (with reference to the longitudinal axis of the steel rail) acute direction or clockwise acute direction, whether the bevel rail gaps are directed in the same direction or in different directions, whether the minimum angle between the bevel rail gap and the longitudinal axis of the steel rail is a big acute angle or small acute angle, and whether the bevel rail gaps on the railways are the same kind of bevel rail gaps or combined rail gaps, the minimum angle between the bevel rail gap and the longitudinal axis of the steel rail at the steel rail joint is selected to be within the range of $15° \leq \theta < 45°$. This is a main feature of the bevel-end steel railway.

2. Longitudinal Rail Gaps are Reserved Between the Bevel-End Steel Rails

The bevel-end steel railway further adopts the design of reserved longitudinal rail gaps, and the longitudinal rail gap with a certain width is reserved between the bevel-end steel rails at the bevel-end steel rail joint. When the length of the bevel-end rails expands and contracts as the temperature changes, the bevel-end steel rails can be flexibly retracted within the reserved longitudinal rail gaps to completely release thermal stress of the steel rails, thereby completely solving the problem of thermal stress of the steel rails.

The technical feature of the reserved longitudinal rail gap design: longitudinal rail gaps are reserved between the bevel-end steel rails.

The use of reserved longitudinal rail gap design does not require the restriction and locking of steel rails, which can not only completely solve the problem of thermal stress on the steel rails, but also reduce the construction and maintenance costs of railway in times.

Longitudinal gaps are reserved between bevel-end steel rails, which is also a technical feature of the bevel-end steel railway.

3. The Cutting Plane of the Steel Rail is Perpendicular to the Rail Bottom Plane of the Steel Rail, and the Minimum Angle Between the Cutting Plane of the Steel Rail End and the Longitudinal Axis of the Steel Rail is Selected to be within the Range of $15° \leq \theta < 45°$.

The bevel-end steel railway uses the design of bevel-end rail gap joint, in order to achieve the bevel rail gap joint between steel rails, flat-end steel rails must be replaced with bevel-end steel rails that can be cross-connected.

The technical features of the bevel-end steel rails: the thickness of the rail waist is the same as the width of the rail head at the bevel-end portion, the cutting planes at both ends of the steel rails are parallel, the cutting plane of the steel rail end is perpendicular to the rail bottom plane of the steel rail, and the minimum angle between the cutting plane of the steel rail and the longitudinal axis of the steel rail is selected to be within the range of $15° \leq \theta < 45°$.

In order to achieve the design of bevel-end rail gap joint, the bevel-end steel rails may have different cutting manners, cutting directions, cutting angles and combinations thereof. However, regardless of the cutting manners, cutting directions, cutting angles and combinations thereof, in order to achieve the design of bevel-end rail gap joint, the requirements must be satisfied: the cutting plane of the steel rail is perpendicular to the rail bottom plane of the steel rail, and the minimum angle between the cutting plane of the steel rail and the longitudinal axis of the steel rail is selected to be within the range of $15° \leq \theta < 45°$. This is a main feature of the bevel-end steel railway.

If the cutting angle of the bevel-end steel rail is smaller (the minimum angle between the cutting plane of the steel rail end and the longitudinal axis of the steel rail is smaller), the wheel-rail impact prevention performance and thermal stress adjustment performance of the bevel-end steel railway are better.

Compatibility and Complementation of Steel Rails with Bevel-End Renovated Standard Steel Rails Bevel-end steel railway adopts a compatible and complementary design of bevel-end and flat-end steel rails, where standard bevel-end steel rails and standard bevel-end renovated steel rails of the same type can be compatible and complementary with each other. The compatible and complementary design of bevel-end and flat-end steel rails includes structure compatible design, length compatible and complementary design and bevel-end compatible design of standard bevel-end steel rails and standard steel rails.

Technical features of the compatible and complementary design of bevel-end and flat-end steel rails: in order to achieve structure compatibility, in addition to different lengths, end cutting methods and bevel portion structures, the rest of the design of the standard bevel-end rails (models, specifications, structures, materials, and production standards) are the same as those of standard steel rails. In order to achieve length compatibility and bevel end complementation, the length of a single rail of the standard bevel-end rails is selected within the design range of $(12.5 \times N + 2a)$m [a is the length of the bevel end of the standard bevel-end steel rails, N=1, 2, 4, 6, 8, 10]. In order to completely solve the problems caused by bevel cutting, the problems including the suspension of the tip of the bevel-end of the steel rail head, declines of the anti-bending and the load-bearing performances of the bevel end, the rail waist thickness is the same as the rail head width at the bevel end for the standard bevel-end steel rail. In order to achieve bevel end compatibility, the ends of the standard steel rails are bevel renovated in accordance with the same cutting standard for standard bevel-end steel rails.

By adopting compatible and complementary designs of flat-end rails and bevel-end rails, the existing equipments and techniques can be continually used for the production of standard bevel-end steel rails, standard steel rails can be continually used by "flat-end into bevel-end renovation", existing sleepers and line accessories can be fully employed, which significantly reduce the construction cost of bevel-end steel railways. By adopting compatible and complementary designs of flat-end rails and bevel-end rails, existing standard steel railways and seamless steel railways can be renovated directly on the line in accordance with "partial interval replacement" and "interval replacement" methods, which can lower the railway renovation cost in times (see pages 19-20 for "partial interval replacement" and "interval replacement").

The technical feature of "partial interval replacement": by partial interval replacement with standard bevel-end steel rails and partial renovation of adjacent standard steel rail ends at both ends of the standard bevel-end steel rails, the transversal rail gaps between the seamless steel rails are converted into bevel rail gaps having longitudinal rail gap clearances, and the seamless steel rails are divided into multiple shorter segments using bevel rail gaps having longitudinal rail gap clearances.

The technical feature of "interval replacement": by interval replacement with standard bevel-end steel rails and interval renovation of adjacent standard steel rail ends at both ends of the standard bevel-end steel rails, the transversal rail gaps or welding seams between the standard steel rails or the seamless steel rails are converted into bevel rail gaps having longitudinal rail gap clearances.

The complementation of standard bevel-end steel rails and bevel-end renovated standard steel rails is a design advantage for the bevel-end steel railway to greatly reduce the construction and renovation costs, which is also one of the technical features of the bevel-end steel railway.

(III) Main Advantages

The main advantages of the bevel-end steel railway:

1. Impact Between Wheels and Rails has been Eliminated

The bevel-end steel railway adopts a small acute angle bevel-end steel rail joint design, which eliminates the transversal rail gap notches in the steel rail plane at the steel rail joint, and can completely eliminate the impact between wheels and rails.

Bevel-end steel railway completely eliminates the impact between wheels and rails, and at the same time eliminates the impact loss of wheels and rails, as well as metal fatigue and related damage caused by impact vibration. Therefore, the bevel-end steel railway can significantly prolong the service life of wheels, rails, sleepers, roadbeds, train accessories and line accessories, and can significantly reduce the maintenance and replacement cost of train and rails. The elimination of impact between wheels and rails can also significantly reduce the running resistance, vibration and noise of the train, and can further increase the speed and reduce energy consumption.

The design of bevel joints with small acute angles can also multiply thermal stress adjustment performance of railways and enable the bevel-end steel railway to operate normally in areas with various temperature differences.

2. The Problem of Thermal Stress has been Completely Solved

The bevel-end steel railway further adopts the design of reserved longitudinal rail gaps, which can completely release thermal stress of the steel rails and can solve thermal stress problem of the steel rails without any potential risk.

A longitudinal rail gap with a certain width is provided between adjacent bevel-end steel rails for bevel-end steel railway, and when the length of the bevel-end steel rails expands and contracts with temperature, they can expand and contract freely in the reserved longitudinal rail gap, which allows thermal stress of the steel rails to be completely released. Since there is no welding but a longitudinal rail gap between the bevel-end steel rails, of course there will be no problems of rail fracture and rail expansion. Therefore, the bevel-end steel railway can solve the problem of thermal stress of the steel rail without any potential risk.

The use of reserved longitudinal rail gap design does not require the restriction and locking of steel rails, which can completely eliminate potential safety hazards and can also reduce the cost of railway construction in times.

3. Improved Safety and Reliability

The structure of the bevel-end steel railway is very simple. According to the theory of reliability, the simpler the structure of a system is, the higher its reliability is; the simpler the composition of the system is, the easier the installation, the more convenient the inspection and the faster the maintenance is, which facilitate the system to maintain designed performance and reliability.

Bevel-end steel railway completely eliminates the impact between wheels and rails, and at the same time eliminates the impact loss of wheels and rails, as well as metal fatigue and related damage caused by impact vibration. Therefore, the bevel-end steel railway can significantly reduce probability of failure of wheels, rails, sleepers, roadbeds, train accessories and line accessories, which greatly improves safety and reliability of the railway.

The bevel-end steel railway adopts a reserved longitudinal rail gap design to solve thermal stress problem of the steel rails, without the need to restrict and lock the steel rails, and can significantly reduce the quality requirements, stress strength, and failure probability of rail fasteners, sleepers and roadbeds, which also can greatly improve safety and reliability of the railway. The bevel-end steel railway adopts bevel-end steel rail joints to eliminate impact between wheels and rails, eliminate the need to weld rails, and completely eliminate safety risk of rail fracture. The designs of reserved longitudinal rail gaps and bevel rail gaps provide superior thermal stress adjustment performance, which can not only make the steel railway operate normally in areas with various temperature differences, but also completely eliminate the safety risks of the rail expansion and rail fracture. It can also significantly improve safety and reliability of the railway.

4. The Train Runs Fast, Smoothly and Quietly

Bevel-end steel railway completely eliminates the impact between wheels and rails, and of course will not produce impact vibration and impact noise. The elimination of impact between wheels and rails can significantly reduce the running resistance of the train, and can further increase the speed and reduce energy consumption. The bevel-end steel rail joint design can significantly improve the smoothness and completeness of the steel rail plane at the bevel-end steel rail joint, and can further reduce the running resistance, running vibration and noise of the train. Therefore, the train runs faster, more smoothly and quietly on the bevel-end steel railway. The passengers ride more comfortably and the cargo transportation is more secure.

5. Construction and Renovation are More Efficient

The bevel-end steel railway has a simple structure, the length of the standard bevel-end steel rail is moderate, and the construction method can be flexibly selected according to construction conditions (manpower or mechanization), which can significantly improve the work efficiency of railway construction and renovation. In the areas of poor construction conditions, during wartime, and during post-disaster reconstruction, the bevel-end steel railway has more outstanding advantages.

The bevel-end steel railway does not require welding and locking of steel rails, which can significantly reduce the technical difficulties and quality requirements for railway construction and maintenance, and can also significantly improve the efficiency of railway construction and maintenance.

The bevel-end steel railway adopts bevel-end and flat-end steel rail compatible and complementary design, and existing railways can be directly renovated on the line according to the "partial interval replacement" and "interval replacement" methods. Only a few of steel rails on the line need to be replaced and renovated. It is not necessary to renovate the existing roadbeds, rail beds and sleepers, which can significantly improve the efficiency of railway reconstruction work.

6. Costs of the Railway can be Greatly Reduced

Bevel-end steel railway completely eliminates the impact between wheels and rails, and at the same time eliminates the impact loss of wheels and rails, as well as metal fatigue and related damage caused by impact vibration. Therefore, the bevel-end steel railway can significantly prolong the service life of wheels, rails, sleepers, roadbeds, train accessories and line accessories, and can significantly reduce the maintenance and replacement cost of train and rails.

The bevel-end steel railways do not require welding and locking of steel rails.

They can be constructed in accordance with the technical standards and quality requirements of standard steel railway, which can reduce the material and labor costs of railway construction.

Standard bevel-end steel rails are of moderate length and are easy to produce, transport and lay, and do not require large-scale production, transportation and laying equipments, which significantly reduce the cost of bevel-end steel rail production, transportation, and layover.

Bevel-end steel railway is designed to be compatible with bevel-end flat-end steel rails and can be used to produce standard bevel-end steel rails using existing equipments and techniques. The standard steel rails can be converted to bevel-end steel rails for continued use, and standard steel rails that are worn out and scrapped can be renovated into bevel-end steel rails to realize waste recovery, which enable continuous use of existing sleepers and line accessories. The huge waste of previous investment caused by the replacement of steel rails, sleepers, line accessories and production equipments as well as huge reinvestment can be avoided, and existing equipments can be used for the large-scale production of railway building materials. By adopting bevel-end and flat-end steel rails compatible with complementary designs, existing railways can be renovated in accordance with the "partial interval replacement" and "interval replacement" methods, which can also reduce the renovation cost of existing railways in times.

The bevel-end steel railway has improved safety and reliability, the train runs more smoothly and safely, the accident probability and the cargo damage rate are lower, and the operating compensation cost of the steel railway can be further reduced.

7. Very High Cost Performance and Wide Application

The bevel-end steel railway can completely solve wheel-rail impact problems and rail thermal stress problems simultaneously, which can not only improve the safety, reliability and durability of the railway in a comprehensive manner, but also significantly increase passenger comfort and cargo transportation safety. It can completely eliminate the safety hazards of rail fracture and rail expansion, and can also operate normally in areas with various temperature differences. It can significantly reduce the costs of construction, operation, maintenance and renovation of the railway, and can also avoid the huge amount of previous investment waste and reinvestment. It can be used efficiently and profitably and is cost-effective, and can be widely used in various third-generation rails and rail facilities.

The bevel-end steel railway is safer, more reliable, more durable, faster and smoother, more comfortable and quieter, and less expensive to build, maintain, and operate. They can be used in a variety of third-generation high-performance, high-speed, low-energy passenger railways. It can also be widely used in third-generation subways, light rails and trams.

The bevel-end steel railway has improved safety and reliability, faster and smoother driving, and can significantly improve the transportation reliability of precision equipments and the transportation safety of inflammable and explosive materials. The use of bevel-end steel railway is more efficient, more durable and energy-saving and more convenient for maintenance, and can significantly reduce the costs of railway construction, maintenance and operation as well as freight risks. It can be widely used in a variety of third-generation high-performance, low-energy high-speed freight railways and mining railways.

Compared with the first generation of standard steel railways, the bevel-end steel railway can not only completely solve thermal stress problem of the steel rails, but also completely solve the problem of impact between wheels and rails simultaneously. It can not only enable the train to operate safer, faster, and more stable, quiet and energy-efficient, but also significantly reduce the maintenance and operating costs of trains and railways. Therefore, the bevel-end steel railway will completely replace the standard steel railway.

Compared with the second generation of seamless steel railways (including high-speed railways), the bevel-end steel railway can completely solve the problem of impact between wheels and rails, and can solve the problem of thermal stress of the steel rails without any potential risk. The safety, reliability, stability and riding comfort of the bevel-end steel railway can be comprehensively improved, and the speed can be increased and the energy consumption can be reduced f. It can not only significantly improve the efficiency of railway construction, maintenance and operation, but also significantly reduce the construction, maintenance, renovation and operation costs of railways. In particular, the construction and maintenance costs of high-speed rails and the maintenance costs of bullet rails can be reduced. Therefore, the bevel-end steel railways will definitely replace the second generation of seamless steel railways (including high-speed railways).

The bevel rail joint design can eliminate the impact and vibration between wheels and rails, and can also significantly improve the rail plane smoothness at the rail joint. Therefore, the train can travel on the railway in an extremely stable manner, and the bevel rail joint design can be widely used for connection of various rail facilities. If it is used for connection between a crane and the pathway for hoisting, the vibrations of cranes during hoisting can be eliminated. For flammable, explosive and fragile goods as well as precision equipments, the safety during mobile hoisting can be significantly improved.

BRIEF DESCRIPTION OF THE DRAWINGS (I) FIG. 1

FIG. 1 is a schematic diagram of a force transfer process of a steel rail at a flat-end steel rail joint. FIG. 1 comprises a top plan view of a rail plane at the flat-end steel rail joint and a rectangular coordinate system corresponding thereto.

(II) FIG. 2

FIG. 2 is a schematic diagram of a force transfer process at a joint of a bevel-end steel rail. FIG. 2 comprises four sets of sub diagrams of FIG. 2(*a*), FIG. 2(*b*), FIG. 2(*c*) and FIG. 2(*d*). T The four sets of sub diagrams each comprises a top plan view of the rail plane at the bevel-end steel rail joint and a rectangular coordinate system corresponding thereto in the vertical direction.

(III) FIG. 3

FIG. 3 is a top plan view of the bevel-end steel rail joint with the bevel end being cut with five acute cutting angles. FIG. 3 can be used for intuitive understanding of the relationship between the cutting angle of the bevel-end steel rail and the notch length of the transversal rail gap of the bevel-end steel rail.

(IV) FIG. 4

FIG. 4 is a top plan view of the rail plane at the bevel-end steel rail joint. FIG. 4 can be used for accurate understanding of the relationship between the width of the transversal notch, the longitudinal rail gap width, and the cutting angle of the bevel-end steel rail at the bevel-end steel rail joint.

(V) FIG. 5

FIG. 5 is a top plan view of the rail plane at the bevel-end steel rail joint. FIG. 5 can be used for accurate understanding of the relationship between the bevel width of the rail plane at the bevel-end steel rail joint, the width of the longitudinal rail gap, and the cutting angle of the bevel-end steel rail.

(VI) FIG. 6

FIG. 6 is a top plan view of the steel rail. FIG. 6 can be used for accurate understanding of the relationship between the cutting angle of the bevel-end steel rail, the length of the steel rail bevel, and the length of the bevel of the steel rail plane.

(VII) FIG. 7

Figure 7:
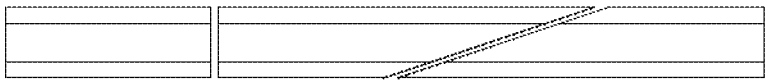

FIG. 7 is a top plan view of the steel rail. On the left side of FIG. 7 is a schematic view of a transversal right-angled cutting of the steel rail, and on the right side of FIG. 7 is a schematic view of a small acute-angled bevel cutting of the steel rail.

(VIII) FIG. 8

Figure 8:
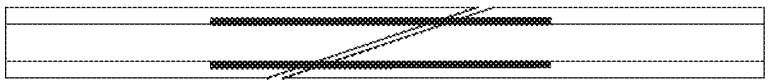

FIG. 8 is a top plan view of the bevel-end steel rail joint. FIG. 8 can be used for intuitive understanding of the steel rail connection method of the bevel-end steel railway, and the two black thick lines in the drawing are the holders at the steel rail joint.

DETAILED DESCRIPTION OF ILLUSTRATED EMBODIMENTS

The bevel-end steel railway design has a simple structure, is easy to construct and renovate, can be constructed flexibly in various methods, has obvious cost advantages, and can be easily promoted and implemented.

(I) Production and Renovation of Standard Bevel-End Steel Rails

In order to establish a standardized bevel-end steel railway, it is necessary to establish a uniform construction standard for the bevel-end steel railway. In order to avoid unnecessary troubles in the production, laying and replacement of steel rails, it is necessary to establish a uniform rail production standard for the bevel-end steel rails.

1. The Production Standard for the Bevel-End Steel Rails (1) Structure of the Bevel-End Steel Rails Standard bevel-end steel rail structure: standard bevel-end steel rails are designed to be compatible with bevel-end flat-end steel rails. Except for the length and end structure, the rest of the design (type, size, structure, material, and production standard) is the same as that of the standard steel rails.

(2) Standard of Bevel End Processing

Standard of bevel end processing for the standard bevel-end steel rails: the cutting plane of the steel rail is perpendicular to the rail bottom plane of the steel rail, and the minimum angle between the cutting plane of the steel rail and the longitudinal axis of the steel rail is selected to be within the range of $15° \leq \theta < 45°$.

The cutting method of the standard bevel-end steel rail is shown in FIG. 7. FIG. 7 is a top plan view of the steel rail. On the left side of FIG. 7 is a schematic view of a transversal right-angled cutting of the steel rail, and on the right side of FIG. 7 is a schematic view of the standard bevel-end steel rail cut according to the production standard of the bevel-end steel rails.

It can be seen from FIG. 7 that after the steel rail blank is cut according to the production standard of the standard bevel-end steel rails, the end of the steel rail has been changed from a flat end to a small acute angled (15° counterclockwise, with reference to the longitudinal axis of the steel rail) bevel end. It can also be seen from FIG. 7 that under the condition that a longitudinal rail gap of the same width is reserved, the width of the bevel rail gap of the standard bevel-end steel rails is obviously smaller than the width of the transversal rail gap of the standard steel rails.

(3) Length of Bevel-End Steel Rails

Length of standard bevel-end steel rails: the "effective length" of standard bevel-end steel rails is 25 meters, and length of a single rail of the standard bevel-end steel rails is (25+2a) meters [a is the length of the bevel end of the bevel-end steel rails].

The standard bevel-end steel rail is designed with a 15° cutting angle and an effective length of 25 meters. Since the bottom width and the rail plane width of different types of steel rails are different, the bevel end length, rail plane bevel end length and single rail length of different types of standard bevel-end steel rails are different. Due to the compatible and complementary design of the bevel-end and flat-end steel rails, length compatibility and bevel end complementation can be achieved for both the same type of standard bevel-end steel rails and bevel-end steel rails renovated from the same type of standard steel rails.

After the model of the steel rails is selected, the bevel end length (a) of the bevel-end steel rails of this type can be calculated according to formula (8), and the single rail length of the bevel-end steel rails of this type can be calculated accordingly.

Take P50 steel rail as an example: P50 steel rail bottom width=0.132 meters, tan 15°=0.2679, according to formula (8), it can be calculated that the bevel end length (a) of standard P50 bevel-end steel rail=0.4926 m, the single rail length of standard P50 bevel-end steel rail=(25+2a) meters, approximately 25.99 meters.

2. Production of Standard Bevel-End Steel Rails

The standard bevel-end steel rails can be produced using the existing standard steel rail production line. It is only necessary to change the cutting process of the standard steel rail production line from transversal cutting to bevel-end cutting, and then set the single rail length of the standard bevel-end steel rail according to the model of the steel rail. In this way, the standard steel rail production line can be converted into a standard bevel-end rail production line.

3. The Bevel-End Renovation of the Standard Steel Rails

The bevel-end renovation of the standard steel rails is very simple, and it is only necessary to bevel cut the ends of the standard steel rails in accordance with the processing standard of bevel ends of the standard bevel-end steel rails.

After re-cutting the two ends of the standard steel rails, the 25-meter standard steel rails can be converted into "flat-end into bevel-end renovated steel rails" with an "effective length" of (25−2a) meters. The 12.5-meter standard steel rail can be converted into "flat-end into bevel-end renovated steel rails" with an "effective length" of (12.5−2a) meters.

When renovation standard steel railways rails and seamless steel railways, it is also possible to directly bevel cut the ends of standard steel rails and seamless steel rails that are retained (without being disassembled) on the line using a rail type steel rail bevel end cutter.

(II) Construction of Standardized Bevel-End Steel Railway

The construction of standardized bevel-end steel railway should adopt a combination of new construction and reconstruction, to avoid waste of investment in the past and reduce reinvestment. It is also necessary to establish a unified technical standard, optimize the selection of construction plans, scientifically manage the construction, strictly carry out quality acceptance and adopt competitive bidding, to maximize the efficiency and benefit of construction and reconstruction.

1. Construction Standard for Bevel-End Steel Railway

Bevel-end steel railway does not require welding, restraint and locking of steel rails. It can be constructed in accordance with the technical standards and quality requirements for standard steel railway. The construction method can be flexibly selected according to construction conditions (manpower or mechanization). Therefore, the technical difficulty of railway construction can be reduced and the cost of railway construction can be lowered in times.

2. Connection of Bevel-End Steel Railway

On the bevel-end steel railway, the standard bevel-end steel rails are still connected by means of holders to form a continuous rail line, and at the steel rail joints of the bevel-end steel railway, the holders, bolts, nuts, and spring washers are still used for connection and fixation.

The connection of a bevel-end steel railway is shown in FIG. 8. FIG. 8 is a top plan view of a bevel-end steel rail joint. In the drawing, two black thick wires are the holders of the steel rail gaps. FIG. 8 also shows that the rail gap at the joints of the bevel-end steel rails is a small acute angle bevel-end steel rail gap.

3. Construction Steps of the Bevel-End Steel Railway

According to the construction standard for standardized bevel-end steel railway, it is only necessary to lay the roadbeds, track beds and sleepers according to the technical standards and quality requirements of standard steel railway, to reserve longitudinal rail gaps between standard bevel-end steel rails according to the design requirements, and to connect the standard bevel-end steel rails in succession with holders and fix them to the sleepers. In this way, a low-cost, high-performance, standardized bevel-end steel railway can be built.

(C) Low-Cost Renovation of Flat-End Steel Railway

The stock of various flat-end steel railways is huge, which will inevitably result in great waste. It will also take a lot of money to carry out the renovation in the traditional ways. It is necessary to study the method of low-cost reconstruction.

The bevel-end steel railway adopts the bevel-end and flat-end rails compatible and complementary design, which can use existing equipments to produce bevel-end steel rails, can continue to use the standard steel rails after renovation, can continue to use the existing sleepers and line accessories, and thus can greatly reduce the cost of reconstructed building materials for the steel railways. By using bevel-end and flat-end rails compatible and complementary design, the flat-end steel rails can be renovated directly in accordance with the "partial interval replacement" and "interval replacement" methods, where it is only necessary to replace and renovate a small number of standard steel rails on the line, without the need to renovate the original roadbeds, track beds, and sleepers, which can also greatly reduce the cost of railway reconstruction. The quality standards and technical requirements for the bevel-end steel railway are the same as those for the standard steel railway, which can also significantly reduce the reconstruction cost of the seamless steel railway.

1. Renovation Method of Flat-End Railway

Existing flat-end railways can be divided into two types: a standard steel railway that is composed of standard steel rails and is fixed in a conventional manner; and a seamless steel railway that is composed of welded seamless steel rails or an ultra-long seamless steel rails and is fixed by locking. Since various high-speed railways use the design of seamless lines and seamless steel rails, the high-speed railways are also categorized as seamless steel railways.

Various existing flat-end railways can be reconstructed in a variety of ways. In view of different conditions such as railway road conditions, connection and fixing methods, regional temperature differences and railway importance, renovation can be optimized using "partial interval replacement", "interval replacement", "entire replacement" or "Total reconstruction" methods.

(1) "Partial Interval Replacement"

"Partial Interval Replacement" is used for high efficiency, low cost renovation of various seamless steel railways.

"Partial interval replacement": the standard bevel-end steel rails are placed at intervals between the seamless steel rails of the seamless steel railway, and the transversal rail gaps between the seamless steel rails are all converted into bevel rail gaps, thereby completely eliminating the problem of the still existing impact between the rails and the rail gaps of the seamless steel railway. Further, according to the requirement of thermal stress relief in areas with various temperature differences, an appropriate proportion of standard bevel-end steel rails are replaced with at equal intervals on each seamless steel rail. The seamless rails are divided by the bevel gaps with longitudinal clearance into several shorter sections. The superior thermal stress relief performance at the bevel-end steel rail joints and thermal stress limiting function of the seamless steel rails having the shorter sections and locked on the sleeper are combined to achieve the comprehensive effects of the interval relief and interval limit of thermal stress of the steel rails, so as to eliminate the potential risk of thermal stress of the steel rails of the seamless steel railway. By replacing with standard bevel-end steel rails at intervals between and on the seamless steel rails, the problem of wheel-rail impact and the potential risk of thermal stress on the steel rails can be completely eliminated.

"Partial interval replacement" construction method: a standard steel rail is removed on the side of the flat-end joint between the seamless steel rails, the standard steel rail flat ends at both ends of the steel rail blank are bevel cut in accordance with the bevel cutting standard for the standard bevel-end steel rails, and then the standard bevel-end rail can be placed in the blanks of the steel rails. On the seamless steel rails, the number of standard bevel-end steel rails to be replaced with should be designed according to the requirement of thermal stress relief in areas with various temperature differences, standard steel rails should be disassembled at welding seams at equal intervals of the seamless steel rails, the flat ends of the standard steel rails at both ends of the steel rail blanks are bevel cut in accordance with the bevel cutting standard for the standard bevel-end steel rails, and then the standard bevel-end steel rails can be assembled at the steel rail blanks. The renovation work can be carried out on the seamless steel railway simultaneously. When designing the positions for disassembling and replacement of the steel rails, the length and spacing of the standard bevel-end steel rails and the "flat-end into bevel-end renovated steel rails" should be considered for subsequent renovation.

The technical feature of "partial interval replacement": by partial interval replacement with standard bevel-end steel rails and partial renovation of adjacent standard steel rail ends at both ends of the standard bevel-end steel rails, the transversal rail gaps between the seamless steel rails are converted into bevel rail gaps having longitudinal rail gap clearances, and the seamless steel rails are divided into multiple shorter segments using bevel rail gaps having longitudinal rail gap clearances.

Performance of "partial interval replacement" renovated railways: after the railway is first renovated in a "partial interval replacement" manner, the wheel-rail impact prevention performance is exactly the same as that of a standard bevel-railway. By adjusting the ratio of bevel-end steel rails on the seamless steel rails renovated in a "partial interval replacement" manner, thermal stress relief performance of the seamless steel rails in each section can be adjusted. At the same time, thermal stress limiting function of the seamless steel rails with each of the sections locked on the sleepers can be used to achieve combined effect of thermal stress relief and thermal stress limiting of the steel rails, so that thermal stress adjustment performance of the renovated railway is basically the same as that of the standard bevel-end steel railway. When periodic subsequent renovation is carried out in conjunction with line replacement cycle, the "partial Interval replacement" approach may continue to be followed. By gradually replacing the standard steel rails welded on the seamless steel railways with the standard bevel-end steel rails and by renovating them at intervals into "flat-end into bevel-end renovated steel rails", the seamless steel railway can be gradually renovated into "flat-end into bevel-end renovated steel railway" "replaced at intervals". Wheel-rail impact prevention performance and thermal stress adjustment performance of "flat-end into bevel-end renovated steel railway" is identical to that of a standard bevel-end steel railway, and maintenance can be performed in full accordance to the technical requirements for a standard steel railway.

(2) "Interval Replacement"

"Interval replacement" is used for high-efficiency, low-cost renovation of various standard steel railways, as well as high-efficiency, low-cost renovation of various seamless steel railways in areas with large temperature differences or on major trunk lines.

"Interval replacement": the standard steel rails on a standard steel railway or a seamless steel railway are ranked according to the connection sequence or welding sequence, and all the standard steel rails at even-numbered positions are to be replaced by standard bevel-end steel rails, the odd-numbered positions are to remain and not to be disassembled, both ends of the remained standard steel rails are bevel cut and renovated in a standard manner, and then the "flat-end into bevel-end renovated steel rails" that are remained and renovated are reconnected with the replaced standard bevel-end steel rails to form a "flat-end into bevel-end renovated steel railway".

The technical feature of "interval replacement": by interval replacement with standard bevel-end steel rails and interval renovation of adjacent standard steel rail ends at both ends of the standard bevel-end steel rails, the transversal rail gaps or welding seams between the standard steel rails or the seamless steel rails are converted into bevel rail gaps having longitudinal rail gap clearances.

Performance of "interval replacement" railway: after various standard steel railways and seamless steel railways are renovated in an "interval replacement" manner, all transversal rail gaps or welding seams between the steel rails on the line have been converted to have bevel rail gaps with longitudinal clearance. Therefore, the wheel-rail impact prevention performance and thermal stress adjustment performance of the "flat-end into bevel-end renovated steel railway" are exactly the same as those of standard bevel-end steel railway, and the entire line can be repaired and maintained according to the technical requirements for standard steel railway. "The flat-end into bevel-end renovated steel railway" is also featured as interval combination and connection of standard bevel-end rails [length=(25+2a) meters] and "flat-end into bevel-end renovated steel rails" [length=(25−2a) meters].

(3) "Entire Replacement"

"Entire replacement": the steel rails are all replaced with standard bevel-end steel rails or "flat-end into bevel-end renovated steel rails" on the existing roadbed, track bed and sleeper, so that the standard bevel-end steel rails or "flat-end into bevel-end renovated steel rails" are assembled into the bevel-end steel railway.

"Entire replacement" is used for various standard steel railways and seamless steel railways where the overall quality of roadbed, track bed and sleeper is up to standard while the overall quality of steel rails on the line is not up to standard. The performances of the steel railway renovated in an "Entire replacement" manner are exactly the same as those of standard bevel-end steel railway.

(4) "Total Reconstruction"

"Total reconstruction": the bevel-end steel railway is reconstructed on the original site of the steel railway line.

"Total reconstruction" is used for various standard steel railways and seamless steel railways where the overall quality of roadbed is not up to standard. The performance of the railway renovated in a "total reconstruction" manner is the same as that of the standard bevel-end railway.

2. Low-Cost Renovation of Seamless Steel Railway

The construction standard for seamless steel railways (including high-speed railways) are obviously higher than that of standard steel railways, the quality indicators of line accessories, sleepers and roadbeds are also significantly higher than those of standard steel railways, the time for railway construction is generally shorter and the road conditions are generally better. In order to minimize renovation cost of seamless steel railways (including high-speed railways) and improve the renovation efficiency, it is necessary to carry out renovations in accordance with the "partial interval replacement" or "interval replacement" method according to the temperature differences of the areas where the steel railways are located and the importance of the railways.

(1) In Areas with Relatively Small Temperature Differences

In areas having relatively small temperature differences, if the quality of the steel rails, roadbeds, track beds, and sleepers of seamless steel railways (including high-speed railways) are all up to standard, they should be renovated in accordance with the "partial interval replacement" method.

(2) In Areas with Relatively Large Temperature Differences

In areas with relatively large temperature differences, if the quality of steel rails, roadbeds, track beds, and sleepers of seamless steel railways (including high-speed railways) are all up to standard, they should be renovated in accordance with the "partial interval replacement" method. However, it is necessary to place more equally spaced standard bevel-end steel rails on seamless steel rails to effectively improve thermal stress adjustment performance.

(3) In Areas with Large Temperature Differences

In areas with large temperature differences, due to the greater thermal stress of the steel rails on the line, in order to ensure the safety of the steel railway, a one-time thorough renovation should be carried out in accordance with the "interval replacement" method, so that the wheel-rail impact prevention performance and thermal stress adjustment performance of the "flat-end into bevel-end renovated steel railway" are exactly the same as those of standard bevel-end steel railway.

In the renovation of seamless steel railway (including high-speed railway), in addition to the factor of temperature differences, line importance, line conditions, and construction time should also be taken into account. For major trunk railways, if they are located in areas with relatively large or large temperature differences, a one-time thorough renovation should be carried out in accordance with the "interval replacement" approach. If the overall condition of the seamless steel railway (including high-speed railway) is general, a one-time thorough renovation should be carried out in accordance with the "entire replacement" approach. If the quality of roadbeds, track beds, or sleepers of the seamless steel railway (including high-speed railway) cannot be fully up to standard, a one-time thorough renovation should be carried out in accordance with the "total reconstruction" approach, no matter whether or not the steel rails are in good condition.

3. Low-Cost Renovation of the Standard Steel Railway

The time for the construction of standard steel railway is generally longer, and the problem of aging of the lines is more prominent. In addition, frequent impacts between the wheels and the rail gaps of the steel rails will also significantly reduce the quality and reliability of the lines. Therefore, during renovation of standard steel railway, based on the specific conditions, a one-time reconstruction should be carried out in accordance to "interval replacement", "entire replacement" or "total reconstruction" method.

(1) The Overall Condition of the Steel Railway is Very Good

If the overall condition of the standard steel railways railway is good, one-time renovation should be carried out in accordance with the "interval replacement" approach.

(2) The Overall Condition of the Steel Railway is General

If the quality of the roadbed, track bed, and sleeper of a standard steel railways railway is up to standard, and the condition of the steel rails is general, a one-time renovation should be performed in accordance with the "entire replacement" method.

(3) The Overall Condition of the Steel Railway is Poor

If the quality of the roadbed, track bed, and sleeper of a standard steel railways railway cannot be fully up to standard, no matter whether the status of the steel rail is good or not, a one-time renovation should be performed in accordance with the "total reconstruction" method.

The bevel-end steel railway can not only improve the safety, reliability, riding comfort, and durability of railways in a comprehensive manner, but also significantly reduce the costs of railway construction, renovation, maintenance, and operation. Waste of huge amounts of previous investments can be avoided, and a huge amount of reinvestment can also be saved. The bevel-end steel railway has created a brand-new mode for high-performance design, high-efficiency use, high-profit operation, and low-cost construction, maintenance and renovation of the steel railway, and has extremely high promotion and application value.

What is claimed is:

1. A bevel-end steel railway, wherein the bevel-end steel railway adopts designs of small-acute-angled bevel rail gap joints and reserved longitudinal gaps; a minimum angle between the bevel rail gap and a longitudinal axis of steel rails at steel rail joints is selected to $15° \leq \theta < 45°$, and longitudinal rail gap clearances are left between the bevel-end steel rails, wherein the longitudinal axis of the steel rails is a centerline of a steel rail plane that is parallel to both edge lines of the steel rail plane and has equal distance from both edge lines of the steel rail plane.

2. The bevel-end steel railway of claim 1, wherein the bevel-end steel rails are used to realize the design of small-acute-angled bevel rail gap joints, a rail waist thickness is the same as a rail head width at a bevel-end portion, cutting planes at both ends of the steel rails are parallel, the cutting planes of the steel rails are perpendicular to a bottom plane of the steel rails, and a minimum angle between the cutting planes of the steel rails and the longitudinal axis of the steel rail is selected to $15° \leq \theta < 45°$.

3. The bevel-end steel railway of claim 1, wherein the bevel-end steel railway adopts an "external rail waist type" holder design for connection of bevel renovated standard steel rails, three side surfaces of the "external rail waist type" holder can be closely matched respectively with a rail waist curve, a lower surface of a steel rail head and an upper surface of a steel rail bottom, and a plane on an outer side of the holder is of the same width as a side surface of the steel rail head.

4. The bevel-end steel railway of claim 1, wherein the bevel-end steel railway adopts a compatible and complementary design of bevel-end and flat-end steel rails, in order to achieve structure compatibility, parameters of standard bevel-end rails including models, specifications, structures, materials and production standards are the same as those of standard steel rails in addition to lengths, end cutting methods and bevel portion structures; a length of a single rail of the standard bevel-end rails is $(12.5 \times N + 2a)$m, where a is the length of the bevel end of the standard bevel-end steel rails, and N=1, 2, 4, 6, 8, or 10; the rail waist thickness is the same as the rail head width at the bevel end for the standard bevel-end steel rails; and ends of the standard steel rails are bevel-renovated in accordance with a cutting standard for the standard bevel-end steel rails.

5. The bevel-end steel railway of claim 4, wherein the standard bevel-end steel rails are compatible with and complementary to bevel: renovated standard steel rails, and the bevel-end steel railway is manufactured in accordance with "partial interval replacement" and "interval replacement" methods, wherein by partial interval replacement with standard bevel-end steel rails and partial renovation of ends of standard steel rails adjacent to both ends of the standard bevel-end steel rails, transversal rail gaps between seamless steel rails are converted into bevel rail gaps having longitudinal rail gap clearances, and the seamless steel rails are divided into multiple shorter segments by the bevel rail gaps having longitudinal rail gap clearances; and by interval replacement with standard bevel-end steel rails and interval renovation of ends of standard steel rails adjacent to both ends of the standard bevel-end steel rails, transversal rail gaps between the standard steel rails or welding seams between the seamless steel rails are converted into bevel rail gaps having longitudinal rail gap clearances; wherein the standard bevel-end steel rails has the technical features of standard bevel-end steel rails and the technical features of compatible and complementary design of bevel-end and flat-end steel rails.

* * * * *